US008487763B2

(12) United States Patent
Dagher et al.

(10) Patent No.: US 8,487,763 B2
(45) Date of Patent: Jul. 16, 2013

(54) BREACH DETECTION SYSTEM FOR CONTAINERS

(75) Inventors: Habib J. Dagher, Veazie, ME (US); Anthony M. Viselli, Bangor, ME (US); Bruce E. Segee, Old Town, ME (US); Ryan E. Fisher, Milford, ME (US)

(73) Assignees: University Of Maine System Board Of Trustees, Bangor, ME (US); Maine Secure Composites, LLC, Orono, ME (US)

( * ) Notice: Subject to any disclaimer, the term of this patent is extended or adjusted under 35 U.S.C. 154(b) by 521 days.

(21) Appl. No.: 12/642,054

(22) Filed: Dec. 18, 2009

(65) Prior Publication Data

US 2010/0201519 A1 Aug. 12, 2010

Related U.S. Application Data

(63) Continuation-in-part of application No. 11/866,655, filed on Oct. 3, 2007, now abandoned.

(60) Provisional application No. 61/139,302, filed on Dec. 19, 2008, provisional application No. 60/927,233, filed on May 2, 2007, provisional application No. 60/872,956, filed on Dec. 4, 2006, provisional application No. 60/850,300, filed on Oct. 6, 2006.

(51) Int. Cl.
*G08B 13/00* (2006.01)

(52) U.S. Cl.
USPC ..... 340/550; 340/652; 109/42

(58) Field of Classification Search
USPC ..... 340/550, 539.1, 652; 109/42
See application file for complete search history.

(56) References Cited

U.S. PATENT DOCUMENTS

| | | | | |
|---|---|---|---|---|
| 3,696,373 | A * | 10/1972 | Dunn et al. | 340/550 |
| 4,972,175 | A * | 11/1990 | MacPherson | 340/550 |
| 4,999,608 | A * | 3/1991 | Galomb | 340/550 |
| 5,289,785 | A * | 3/1994 | MacPherson et al. | 109/42 |
| 5,539,379 | A * | 7/1996 | MacPherson | 340/550 |
| 5,656,996 | A | 8/1997 | Houser | |
| 6,995,669 | B2 * | 2/2006 | Morales | 340/652 |
| 7,019,683 | B2 | 3/2006 | Stevens et al. | |
| 7,271,723 | B2 | 9/2007 | Ando | |
| 7,576,653 | B2 * | 8/2009 | Smith | 340/572.1 |
| 2008/0211669 | A1 | 9/2008 | Dagher et al. | |

FOREIGN PATENT DOCUMENTS

| | | | |
|---|---|---|---|
| JP | 2000122552 | A | 4/2000 |
| JP | 2007065865 | A | 3/2007 |
| WO | 2006019929 | A2 | 2/2006 |

OTHER PUBLICATIONS

Video located on the web page of Tamper Proof Container Systems Corporation: www.tamperproofcontainersystems.com (see link entitled "View TPCS Presentation"); accessed Nov. 15, 2009.

* cited by examiner

*Primary Examiner* — John A Tweel, Jr.
(74) *Attorney, Agent, or Firm* — MacMillian, Sobanski & Todd, LLC

(57) ABSTRACT

A breach detection system for a container includes at least two panels having a first electrical circuit mounted thereto. The panels are configured for attachment to a container. The first electrical circuit is configured to detect an intrusion through any portion of the panel and generate an intrusion signal when the intrusion occurs. A connector electrically connects the first electrical circuits of two panels of the container.

32 Claims, 30 Drawing Sheets

BREACH DETECTION SYSTEM FOR CONTAINERS

CROSS REFERENCE TO RELATED APPLICATIONS

This application is a continuation in part of U.S. patent application Ser. No. 11/866,655 filed Oct. 3, 2007 and which claimed benefit of U.S. Provisional Application Nos. 60/850,300 filed Oct. 6, 2006, 60/872,956 filed Dec. 4, 2006, and 60/927,233 filed May 2, 2007. U.S. patent application Ser. No. 11/866,655 is incorporated herein by reference. This application also claims the benefit of U.S. Provisional Application No. 61/139,302 filed Dec. 19, 2008.

This invention was made with U.S. government support under U.S. Navy Contract No. N66001-05-C-6014. The United States government has certain rights in this invention.

BACKGROUND

Various embodiments of a breach detection system for a container are described herein. In particular, the embodiments described herein relate to improved panels and connectors for a breach detection system for a container.

There has been a recognition that the United States is at risk of the delivery of weapons of mass destruction to its ports by enemies employing a strategy of hiding such a weapon in a shipping container. Various schemes have been proposed for x-raying containers or otherwise examining containers as they are loaded on ships in foreign ports. Such schemes, however, can be very limited in effectiveness since they can be defeated with x-ray shielding, vulnerable to compromise by rogue employees and the contents of the containers altered after they are loaded in a foreign port.

Approximately sixteen million twenty foot containers are in use throughout the world. Additionally, approximately 40 percent of the personnel that load and off-load these containers come from nations with ties to terrorism. Bribery and sabotage are common throughout the shipping industry, including foreign government officials, shipping companies, and freight forwarders. The U.S. government estimates that large quantities of contraband material pass through the maritime commerce into most ports in the U.S.

Shipping containers in current use are primarily made of steel and have considerable drawbacks. The steel containers increase shipping weight, wear out quickly, and can be infiltrated by simple means. Walls or panels made of material other than steel have been considered, but they are typically not made of weldable material. Without a strong weld between adjacent wall panels and between wall panels and the container frame, a container is susceptible to intrusion.

To a limited degree, the notion of enclosing detecting devices, such as sensors or processors, in containers, which communicate with external systems, has been implemented in non-secure applications. For example, Sensitech, based in Beverly, Mass. (www.sensitech.com), provides solutions in the food and pharmaceuticals fields that are used for monitoring temperature and humidity for goods, in-transit, in-storage, and display. Such temperature and humidity monitors are typically placed in storage and transit containers to monitor if desired conditions are maintained.

Such data collection however, is not generally considered sensitive with respect to security issues. Rather, it is used for ensuring that products in a container do not spoil by being subjected to unfavorable temperature and humidity conditions. Secure communications, tamper resistance, and detection are not particularly relevant issues in such settings. Additionally, such monitors do not monitor for the presence of suspicious content or materials, no matter where they may be introduced in the chain.

Even if detectors are introduced into a container and interfaced to an external system, terrorists, violent extremists, and/or criminals may employ any of a variety of strategies to defeat such a detection system. For instance, an enemy may attempt to shield the suspicious materials or activities from the detectors; defeat the communication interface between the detectors and the external system, so that the interface does not report evidence of suspicious materials or activities sensed by the detectors; disconnect the detectors from the interface; surreptitiously load a container that contains an atomic weapon, but that does not contain detecting devices, onto a container ship; overcome external systems so that they incorrectly report on the status of the detectors.

Tamper Proof Container Systems Corporation of Belmont, Mass. (www.tamperproofcontainersystems.com) discloses an anti-intrusion product that uses a polyester mesh with an insulated copper wire, embedded in an elastomer, which fully lines the existing internal surfaces of a cargo container. This system adds weight to the container and may be susceptible to forklift damage since the sensors are bonded to the inside surface of the container.

U.S. patent application Ser. No. 11/866,655 to Habib J. Dagher et al., incorporated herein by reference, discloses various embodiments of a panel comprising multi-layered composite material that can be welded to other components. For example, the composite panel may be welded to the frame of a container or to other like panels to form a tamper-resistant container, such as a shipping container. The composite panel may also contain embedded processors and sensors that can detect intrusion into or tampering of the container.

SUMMARY

The present application describes various embodiments of a breach detection system for a container. One embodiment of the breach detection system for a container includes at least two panels having a first electrical circuit mounted thereto. The panels are configured for attachment to a container. The first electrical circuit is configured to detect an intrusion through any portion of the panel and generate an intrusion signal when the intrusion occurs. A connector electrically connects the first electrical circuits of two panels of the container.

In another embodiment, a container has the breach detection system according to claim 1 and further includes a frame. At least two panels define either one container wall or two adjacent container walls.

In an additional embodiment, a connector for connecting component panels of a breach detection system for a container includes a connector body. A pattern of electrical conductors are embedded in the connector body, defining an electrical circuit. The connector electrically connects electrical circuits of two panels of a breach detection system of a container. The electrical circuits are configured to detect an intrusion through any portion of the panel and generate an intrusion signal when the intrusion occurs.

Other advantages of the breach detection system for a container will become apparent to those skilled in the art from the following detailed description, when read in light of the accompanying drawings.

DETAILED DESCRIPTION

The present invention relates to a panel comprising a panel element formed by a multilayered composite material with edge elements extending from its periphery, which is formed of a weldable material, such as steel. The panels may be welded to a similar panel (or to a frame) to form a tamper-resistant container, such as a shipping container. The panels may be used for other purposes, such as a multipanel wall. The panel elements may contain embedded processors or sensors that detect any intrusion or tampering with the panels.

In one embodiment of the present invention, a panel element is composed of a fiber-reinforced polymer composite material. The reinforced polymer structure may comprise multiple layers of unidirectional fabric in various orientations randomly oriented fabric or woven fabric encased in a resin matrix. In one embodiment, the reinforced polymer structure may consist of E-glass/vinylester composite ("E-glass Composite"), E-glass Composite has specific strength, impact, and durability properties that exceed those of conventional steel.

Figure 1:
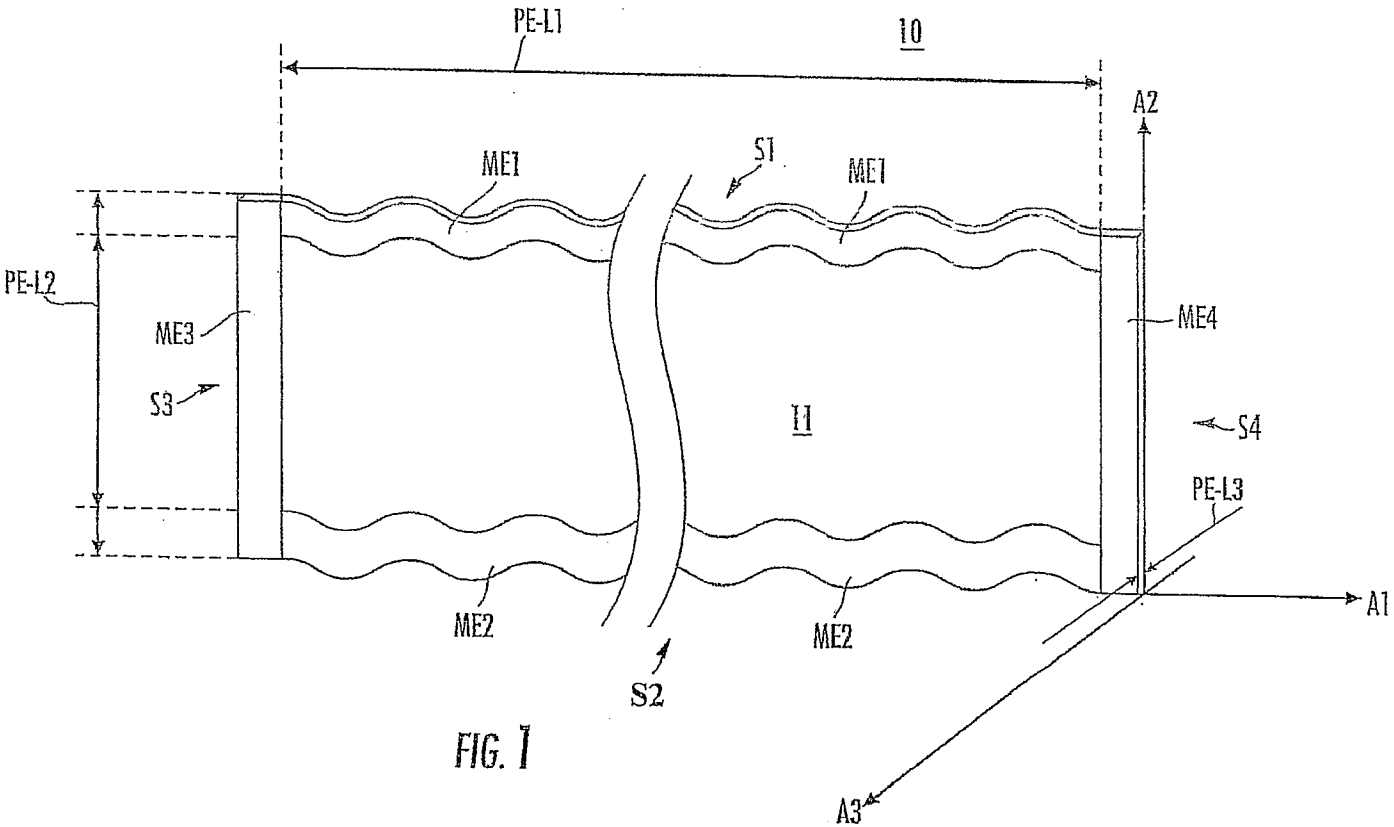
FIG. 1 illustrates a front perspective view of a panel made of multilayered composite material into weldable edges, in accordance with the invention.

Now referring to FIG. 1, an exemplary panel 10 is schematically illustrated with respect to an orthogonal coordinate system formed by axes A1, A2, and A3. The panel 10 includes a central composite panel element 11 having a four-sided rectangular peripheral edge PE. Two of the four sides edges S1, S2 are mutually opposite and extend along a first axis A1, having lengths PE-L1. Two of the four sides S3, S4 are mutually opposite and extend along a second axis A2, having lengths PE-L2. The panel 10 has a substantially uniform thickness PE-L3 along a third axis A3. The panel 10 has a corrugated profile along axis A1, and a linear profile along axis A2.

Figure 1A:
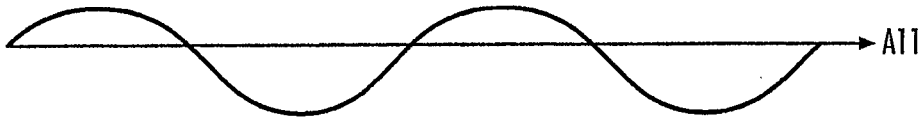
FIGS. 1A and 1B illustrate exemplary corrugation profiles of the panel at FIG. 1.
Figure 1B:
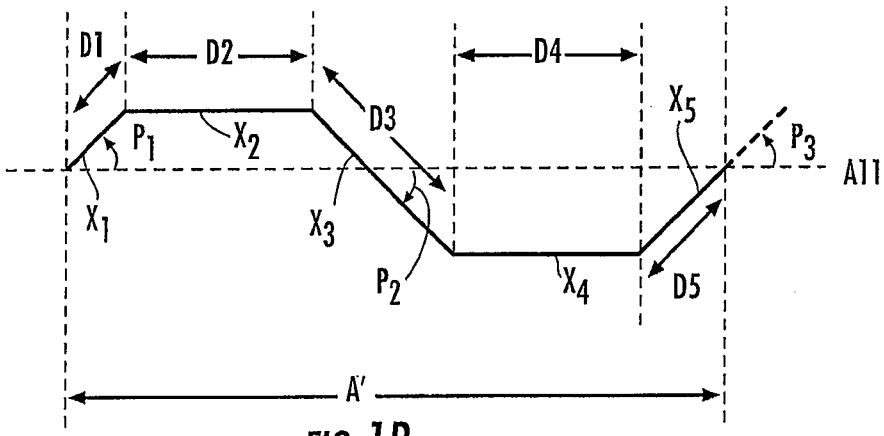

The corrugated profile of sides S1, S2 of the panel 10 is preferably symmetrical about an axis A11 parallel to A1, as shown in FIG. 1A. An asymmetrical corrugation profile may be employed in other embodiments. An exemplary sinusoidal corrugation profile is illustrated in FIG. 1A. An exemplary piecewise linear corrugation profile is illustrated in FIG. 1B; while the junctions of the respective adjacent segments are shown as "sharp," it will be understood that gradual curved junctions are within the scope of "piecewise linear" as used herein in FIG. 1B. The corrugated profile has a piecewise linear repeating pattern $X_1$-$X_2$-$X_3$-$X_4$-$X_5$, wherein $X_1$ extends a distance D1 at a positive non-zero angle P1 from A11. $X_2$ extends a distance D2 parallel to A11. $X_3$ extends a distance D3 at a negative non-zero angle P2. $X_4$ extends a distance D4 parallel to A11 and $X_5$ extends a distance D5 at a positive non-zero angle P3 to A11. In one embodiment, it should be noted that D2=D4 and D1=D5=1/2 D3 and P1=P3=−P2.

Preferably, D1 sin P1 is in the range 0.25 in. to 4.0 in, D2 and D4 are in the range 1.5 in. to 8.5 in. and P1 is in the range 20° to 90°. There are three preferred forms of this geometry. The first preferred form, has dimensions D1 sin P1=1.42 in., D2=2.75 in and P1=27.9°. The second preferred form, has dimensions D1 sin P1=1.80 in., D2=4.33 in and P1=68.5°. The third preferred form, has dimensions D1 sin P1=0.79 in., D2=6.00 in and P1=57°. In yet another form as may be used for a side wall, the dimensions D1 sin P1=2.0 in., D2=2.75 in., and P1=47°

The panel 10 includes a first elongated edge element ME-1 affixed to and extending from and along the first side edge S1, wherein the first edge element ME-1 has a corrugated profile along the first axis A1. A second elongated edge element ME-2 is affixed to and extends from and along the second side edge S2, wherein the second side edge element ME-2 has a corrugated profile along first axis A1. The corrugation profiles of edge elements ME-1 and ME-2 match the corrugation profile of panel element 11.

A third elongated edge element ME-3 is affixed to and extends from and along the third side edge S3, wherein third side edge element ME-3 has linear profile along second axis A2. A fourth elongated edge element ME-4 is affixed to and extends from and along the fourth side edge S4, wherein fourth edge element ME-4 has a linear profile along second axis A2. The first edge element ME-1, second edge element ME-2, third edge element ME-3, and fourth edge element ME-4 are composed of weldable metal, such as steel.

Figure 2C:
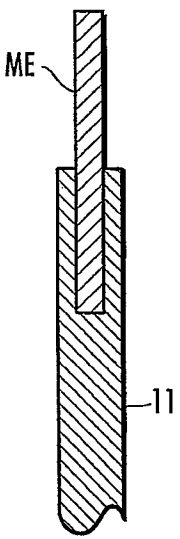
FIGS. 2A-2G illustrate exemplary configurations for metal edges bonded to composite panel elements of the panel of FIG. 1.
Figure 2B:
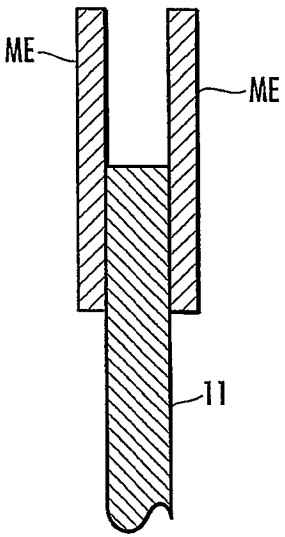
Figure 2A:
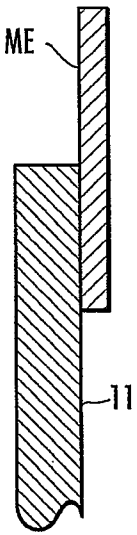

The edge elements (ME) may be joined to the edges of panel element 11 in various manners. For example, the edge elements may be embedded in the edge of a panel as illustrated in FIG. 2C. The edge element (ME) may alternatively be attached to a surface of an edge of the panel element, as shown in FIG. 2A. The edge elements (ME) may alternatively be bonded to the opposite surfaces of the edge of panel element 11 to provide a "sandwich" structure as shown in FIG. 2B. To secure the edge element to the composite panel element, an adhesive, mechanical fastener, or both may be used to bond the edge element to the composite panel element.

Figure 2D:
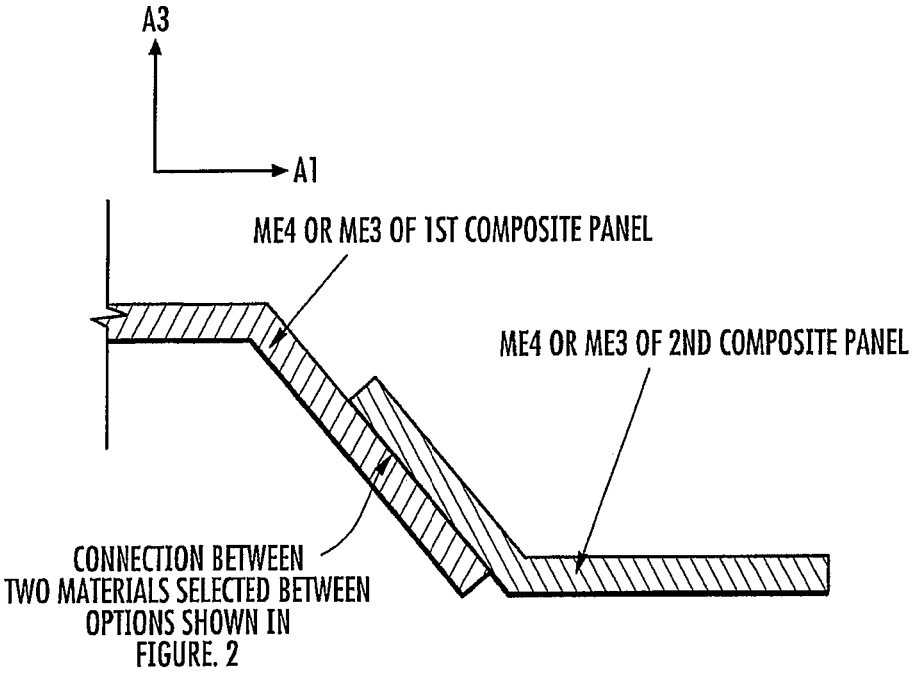

In some embodiments, the edge elements (ME) follow the contour of the surface respective surface. Referring to FIG. 2D, an edge view of a connection between two adjacent corrugated composite panels is shown. The edge elements ME3 and ME4 are angled in a complementary manner, such that an edge element ME3 of a first panel overlaps a complementary edge element ME4 of a second adjacent panel. The overlapping joint can be formed using any of the options shown in FIGS. 2A through 2C. Thus, the resulting joint may reside along an equivalent D1 segment, such that a corrugation pattern of each individual subpanel is substantially maintained across the joined pair of subpanels.

Figure 2E:
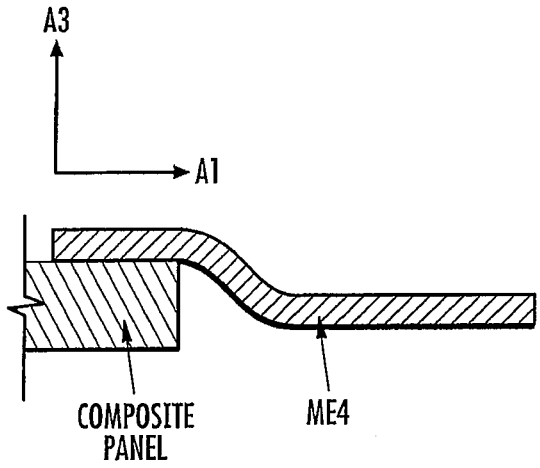
Figure 2F:
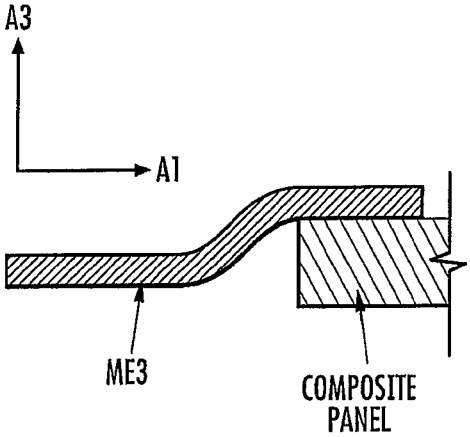
Figure 2G:
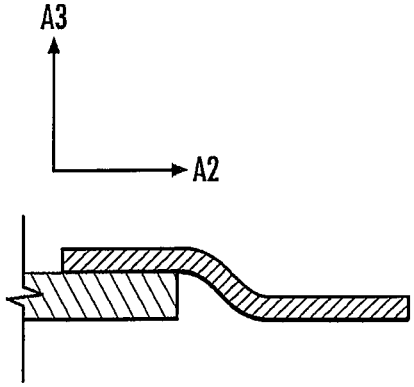

An exemplary side or edge view of edge elements ME3 and ME4 at opposing ends of a composite roof panel are shown in FIG. 2E and FIG. 2F. An exemplary side edge element ME1 or ME2 of the composite roof panel is shown in FIG. 2G.

In a most preferred embodiment, the layered composite material forming panel element 11 has a layer profile $M_2/0_3/90/0/90/0_3/M_2$ wherein subscripts 2 and 3 denote two and three layers respectively, and wherein M denotes a mat fiber layer, 0 denotes a layer with longitudinal fiber orientation parallel to axis A2 and 90 denotes longitudinal fiber orientation perpendicular to the axis A2. In an alternative embodiment, a panel element 11 may have a layered composite material with a profile: $M_2/90/0_3/0/0_3/90/M_2$ wherein subscript 3 denotes three layers, and wherein M denotes a mat fiber layer, 0 denotes a layer with longitudinal fiber orientation parallel to axis A1 and 90 denotes longitudinal fiber orientation perpendicular to the axis A2. Also, a panel may have layered composite material with a profile: $M_3/0_3/0/0_3/M_3$ wherein subscript 3 denotes three layers, and wherein M denotes a mat fiber layer, 0 denotes a layer with longitudinal fiber orientation parallel to the axis A2 and 90 denotes longitudinal fiber orientation perpendicular to the axis A2. The above three layer profiles provide robust panel elements and are preferred in terms of strength and weight for conventional sized container applications, but other layer profiles may be used as well. Test results show better flexural and impact strength than conventional steel container walls.

As described above, the composite containers may include panels that have the above-described configuration. However, in some configurations of containers in keeping with the invention, an alternative panel may be used for the principal payload-bearing floor of a container. In such containers, the floor panel may be a hybrid panel fastened to transverse floor joists, composed of an additional material along with a fiber-reinforced polymer composite material, for example, a hybrid panel as described below.

Figure 3:
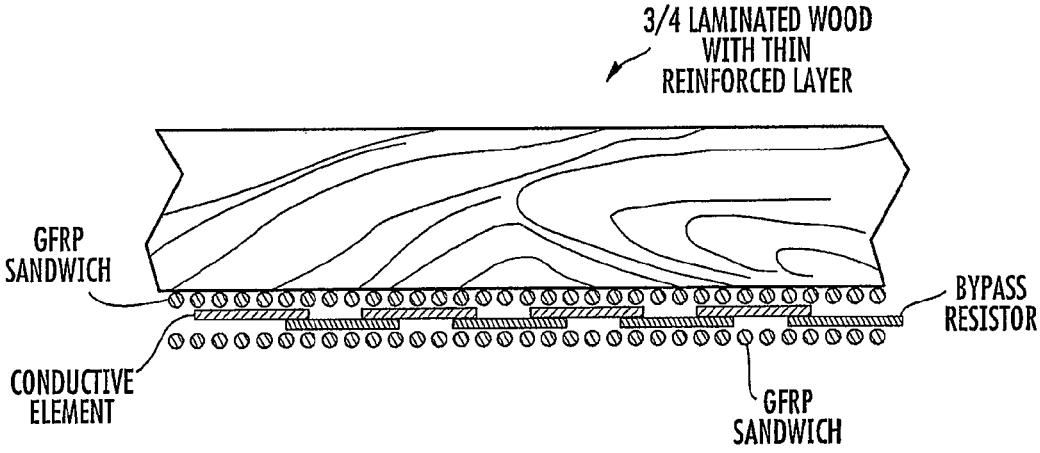
FIG. 3 illustrates a cross-sectional view of a hybrid panel with a wood layer with sensors.

Referring to FIG. 3, a hybrid panel is shown comprising a wood layer and a composite material layer bonded to the bottom side of the wood. The wood layer is preferably ¾ inch laminated plywood including one or more of hard and soft wood, solid-sawn tongue-and-groove hardwood planks, and partially laminated solid-sawn hardwood. The composite material layer is a multilayer fiber/binder structure for example, E-glass/vinylester. As with the panels of FIG. 1, the hybrid panels can include a sensor system embedded within the fiber-reinforced polymer composite layer. The composite component of the hybrid panel provides a host environment for the sensors, protects from the environment, and strengthens the wood in flexure, allowing percent weight reduction over conventional apitong plywood container floors.

Figure 4:
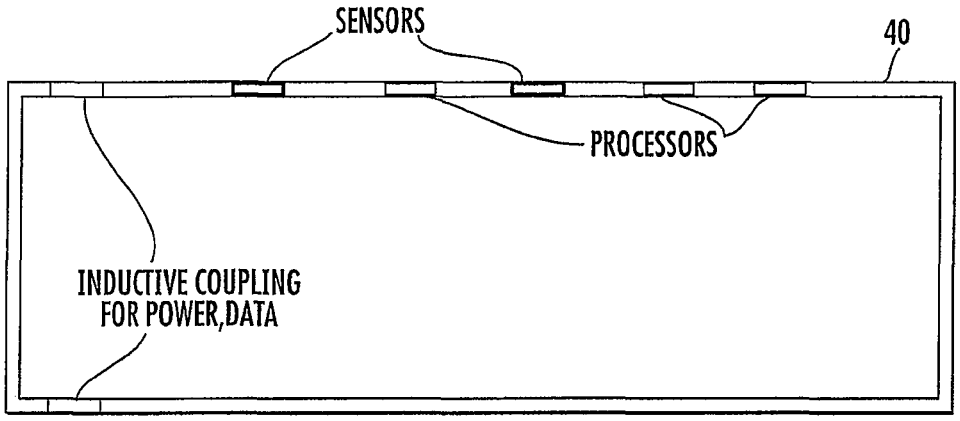
FIG. 4 illustrates a front perspective view of a panel that includes embedded sensors and processors.
Figure 5A:
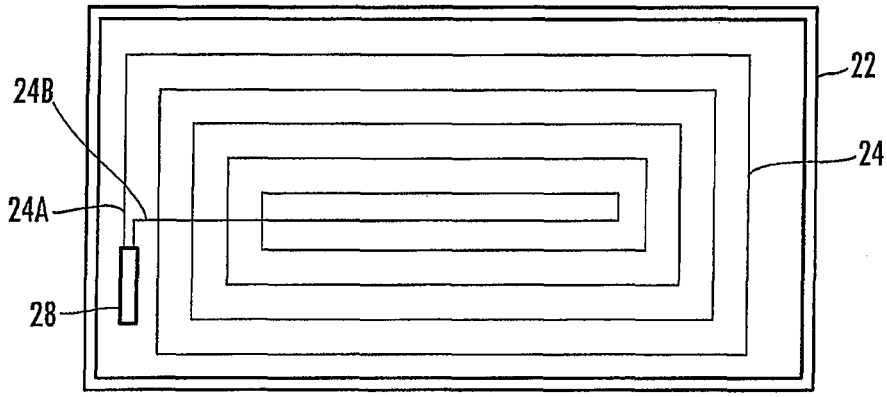
FIG. 5A-5E illustrate front perspective views of a various configurations of a conductive grid within a composite panel.
Figure 5B:
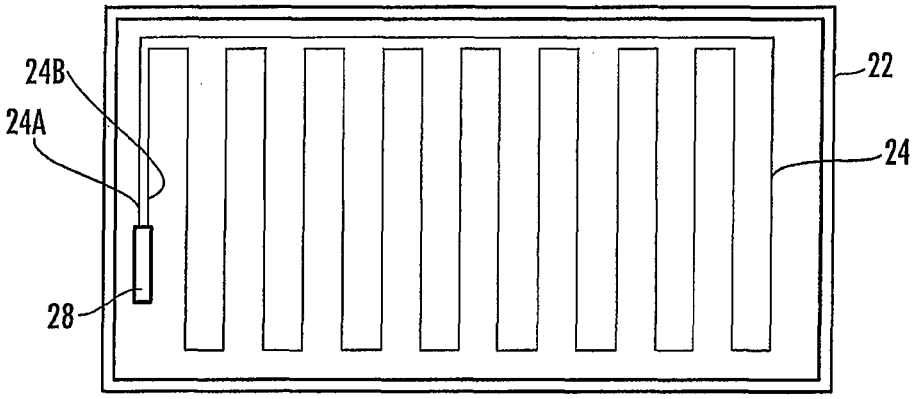
Figure 5C:
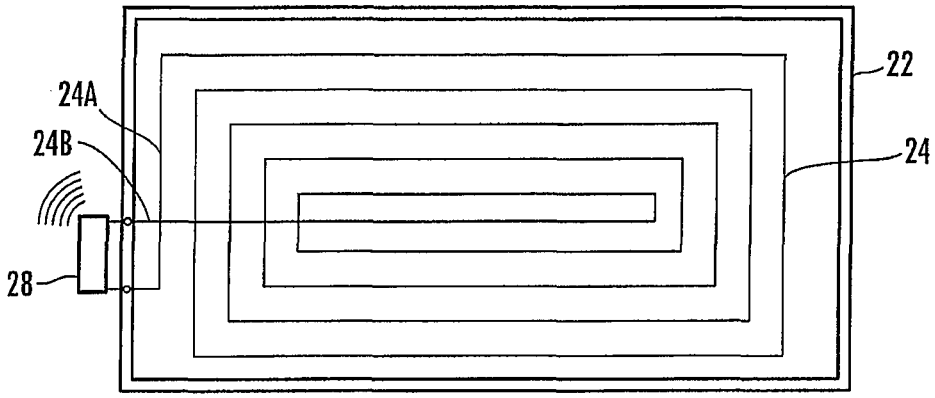
Figure 5D:
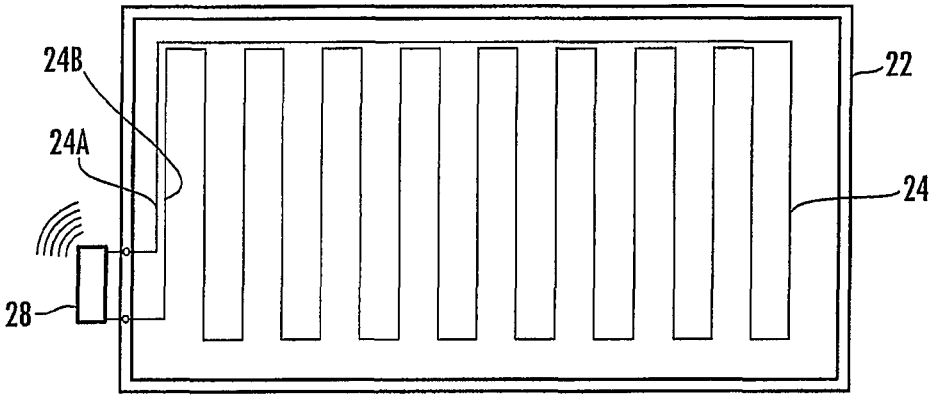

In one embodiment, to meet the primary sensing objectives of breach detection, the panels may include a sensor system embedded therein which can include a series of sensors, processors, and data paths, see FIG. 4. In one form, an advantage of embedding sensors, processors, and other devices in a hardened composite material is that the material acts as a protective coating, which protects the devices from the harsh maritime environment and from tampering. This approach is to be contrasted with placing intrusion sensing devices on existing containers, which do not present a protected environment to externally applied intrusion sensing devices. Another advantage of embedding sensors in the container material is that the entire system can be tested in the factory when the container is first constructed. In one embodiment, the sensor system contains a grid of embedded array of optical fibers and optical sensors. The sensor system may be arranged in a number of different forms. In FIG. 5A, a panel 22 is shown having a single fiber 24 in the form of a spiral, extending between opposite ends 24A, and 24B. An internal optical signal generator/detector 28 is coupled to ends 24A, 24B. The generator/detector 28 is adapted to apply an optical signal to end 24A so that the signal propagates along fiber 24 to end 24B where, provided the fiber 24 is intact, that signal is detected by generator/detector 28. In the event of a breach of the panel 22, the optical fiber 24 would be interrupted so that an applied optical signal would not reach to end 24B. The generator/detector 28 is adapted for remotely controlled operation (actuation and detection). While the generator/detector 28 in FIG. 5A is internal to (embedded in) panel 22, in other embodiments the generator detector is external to the panel 22. In such embodiments, the generator/detector 28 is adapted for remotely controlled operation. FIGS. 5B and 5C illustrate two other configurations of fiber array. In FIG. 5B, a serpentine arrangement is shown where elements similar to elements in FIG. 5A are identified with the same reference designation. Again, in FIG. 5B, the generator/detector 28 is embedded in panel 22. FIGS. 5C and 5D illustrate embodiments similar to those in FIGS. 5A and 5B, but where the optical signal generator/detector 28 is external to panel 22.

Figure 5E:
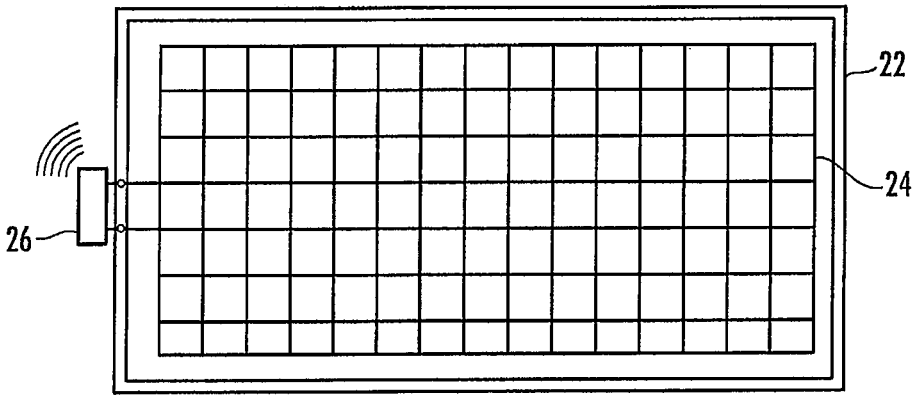

In another arrangement, a panel may include a plurality of optical fibers, each having a first end at an input port in the panel, and extending through panel to a second end at an output port in the panel. An optical driver having a light source is connected to the optical fibers at the input port. Upon receiving a start or activating a signal (coded or uncoded), the driver causes radiation to propagate into the optical fiber at its first end at the input port. An optical detector is coupled to the output port to detect light propagating along the fiber from the input port. The two ends of optical fibers, in some forms, are coupled to switches to permit selective input of light and detecting of light. The switches pen-nit fibers to be pulsed under program control and allow a grid of fibers orthogonally extending (along "x" and "axe") in the container walls. The x axis and y axis fibers are pulsed or actuated selectively under program control, so that the integrity of the various fibers is maintained in a manner permitting detecting of fiber breaks or degradation and locating those breaks based on x and y coordinating grid with this configuration. If an intrusion interrupts or stresses an optical fiber embedded in the composite material of the panels, the use of x and y axes of fibers locates the intrusion. In some arrangements, processors are embedded in the composite material and are electrically connected to the optical drivers. Many optical drivers may be utilized in a container constructed of the composite material. FIG. 5E illustrates a multi-fiber sensor array but without showing the optical signal generators, detectors or switches.

In another form of the invention, the sensor system includes an array of electrical conductors. The array of electrical conductors includes at least one electrical conductor extending between two ends thereof and arranged in multiple configurations. The electrical conductor array can have the same configuration at the optical fiber arrays in FIGS. 5, 5A-5E, and thus are illustrated in those figures. In one embodiment, the serpentine configuration includes at least one resistive bypass path (FIG. 7A) interconnecting between two points along said serpentine configuration. One of said points is adapted to receive an electrical signal. The sensor system includes an electrical signal generator coupled to one end for generating an electrical signal and an electrical signal detector coupled to the other end for detecting the electrical signal. The electrical signal generator can be adapted for remote activation. Also, the detector can be adapted for remote activation. Both the electrical signal generator and the detector can be embedded in the panel or external to the panel.

The processor and sensor type and the density of the processors and sensors in the container walls can be customized to meet a user's needs. Furthermore, in some designs, electrical paths and data paths and various data processing elements such as Complex Programmable Logic Devices (CPLDs) and/or Field Programmable Gate Arrays (FPGAs) or similar elements may be incorporated to provide control and communication functionality. Additionally, to provide energy for these and similar sensors and elements, a power source such as a battery or rechargeable battery may also be embedded in the composite materials. The batteries for powering the sensors and the processors and the light sources are preferably rechargeable batteries, which can be periodically charged. The system is preferably provided with plenty of bandwidth and redundant processing power to fulfill the alerting, data acquisition, and communication requirements of a user.

Figure 6:
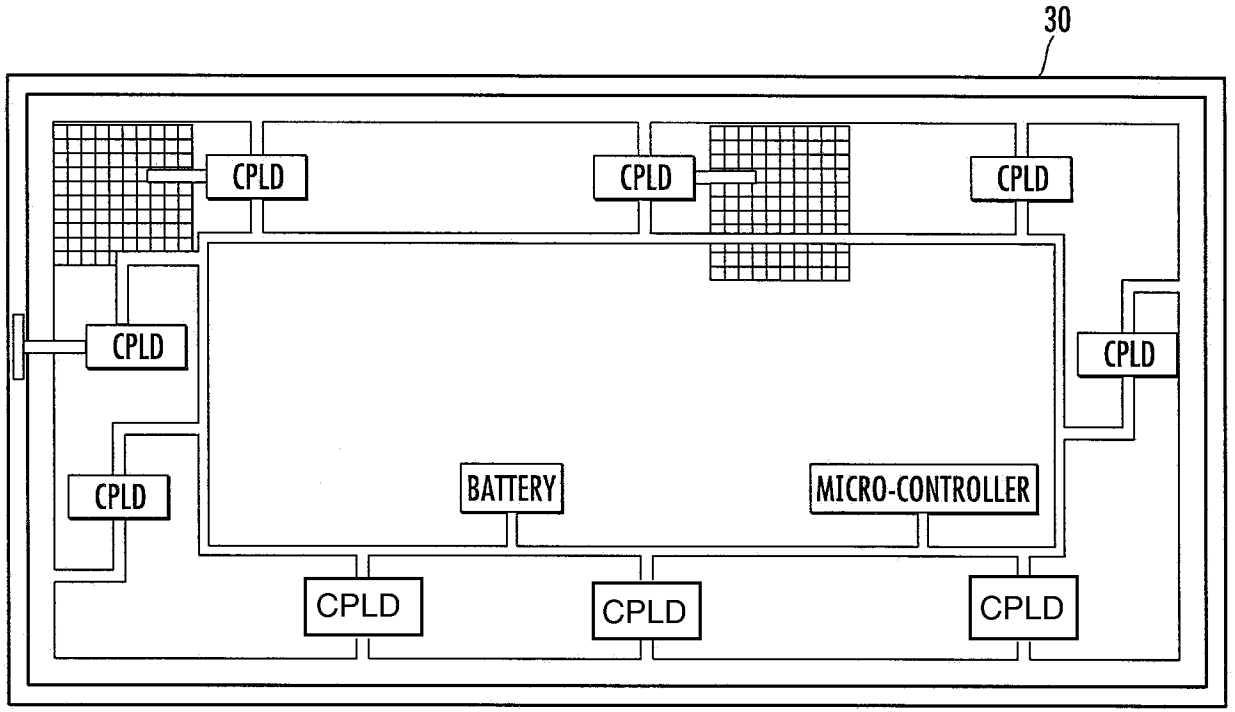
FIG. 6 illustrates a front perspective view of a panel that includes embedded components and buses.

Referring to FIG. 6, in another embodiment, a panel includes one or more processors embedded into the composite material. The processors are powered by a battery connected to the processors. These processors are distributed throughout the composite material in locations that are less likely to be damaged during use. The processors can respond to sudden events and "wake up" in response to alarms to preserve the battery. The wake up may be the result of an intrusion or as the result of receipt of an externally applied RF signal. In some embodiments, to reduce power consumption, the processors wake up on a regular basis. For example, the processor can periodically wake up and provide status, saying "here is my ID, I'm okay."

The processors have the ability to store data in flash memory and erase data from flash memory. Consequently, they may be utilized to provide a coded unchanging ID, which is a number uniquely identifies a particular composite panel, and a certificate, which is a number given after a panel has been inspected, to a composite panel. In one embodiment, a network of processors are coupled together in a substrate grid. The networked processors manage the detection grids and provide IDs and certificates. Upon detection of an intrusion of the panel, the processor may completely destroy the value, IDs and certificates to prevent spoofing of the panels.

Figure 7A:
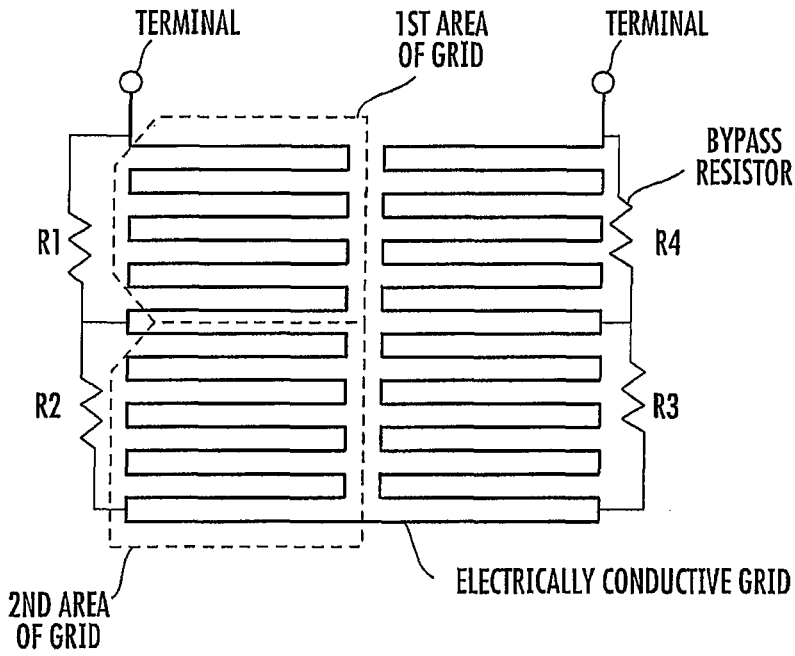
FIG. 7A illustrates a schematic diagram of a sensing circuit including bypass resistors.

Referring to FIG. 7A, in one form of the invention, the panel contains a sensor system that includes a sensing circuit having an electrically conductive path with multiple bypass resistors $R_1$, $R_2$, $R_3$, $R_4$ (generally R). The electrically conductive path includes an array of electrically conductive elements arranged in a circuit, such as a grid, spanning an area of the panel. If the grid is intact, a substantial portion of the electrical current flows through the electrically conductive elements rather than through the bypass resistors R. Consequently, a resulting circuit resistance measured at a pair of circuit terminals indicates a short circuit with a measurable resistance being that of the electrically conductive paths themselves. When the conductive path is broken, at least a portion of the current is then diverted through one or more of the bypass resistors R. The resultant change in resistance is then detectable by a resistance-monitoring circuit.

In some embodiments, the circuit is planar, spanning a substantial area of the panel. In the exemplary embodiment of FIG. 7A, the array of electrical conductive elements are arranged in a series configuration extending between a pair of sensing terminals. The array of electrically conductive elements can be arranged, as shown, to include a serpentine pattern. A first bypass resistor $R_1$ is coupled between two points along the conductive path, such that a portion of the conductive path between the two coupled points covers a first area of the panel. Similarly, the remaining bypass resistors $R_2$, $R_3$, $R_4$ are each respectively coupled between two different points along the same conductive path.

In the exemplary embodiment, a break in the panel interrupts the conductive path and results in current being diverted through the respective bypass resistor R. Thus, a break in the first area of the grid will result in current flowing through the first bypass resistor $R_1$. A resulting resistance measured at the circuit terminals will change from a short circuit to approximate the value of $R_1$. As multiple areas of the same grid are broken, the current will be diverted through one or more additional bypass resistors R. The resulting circuit produces a voltage drop that depends upon the combination of bypass resistors through which the current is flowing. Should one or more breaks interrupt conductive paths in other areas of the exemplary series-configured sensing circuit, voltage drop at the terminals will be the sum of the voltage drops across all of the bypass resistors through which current is flowing. In some embodiments, one or more of the bypass resistors provide different resistive values that can be used to identify locations of one or more areas of the panel that are breached.

Figure 7B:
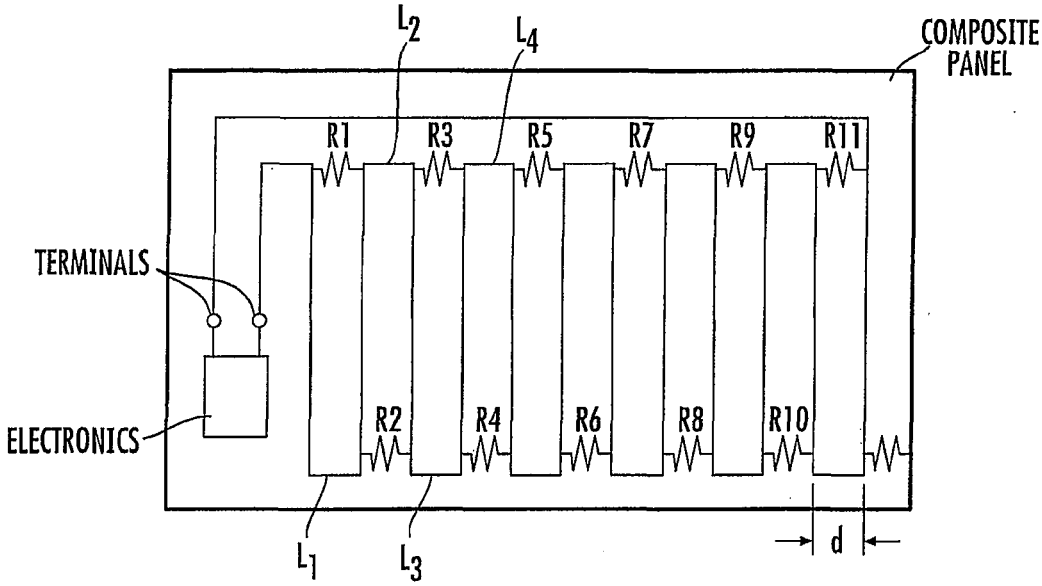
FIG. 7B illustrates a schematic diagram of one embodiment of a panel with an embedded circuit including sensors and bypass resistors.

An exemplary embodiment of a panel sensing circuit including bypass resistors is shown in FIG. 7B. The sensing circuit includes a serpentine conductive path spanning a substantial region of a composite panel. The serpentine path includes multiple U-shaped circuit legs $L_1$, $L_2$, $L_3$, . . . (generally L) coupled together in a series configuration. Each of the circuit legs L is connected in a parallel or shunt configuration to a respective bypass resistor $R_1$, $R_2$, $R_3$, . . . (generally R). The series circuit formed by the serpentine conductive path and bypass resistors R also includes a pair of terminals. A break in any one of the circuit legs L will result in a diversion of electrical current from the leg and through the bypass resistor R.

Figure 7C:
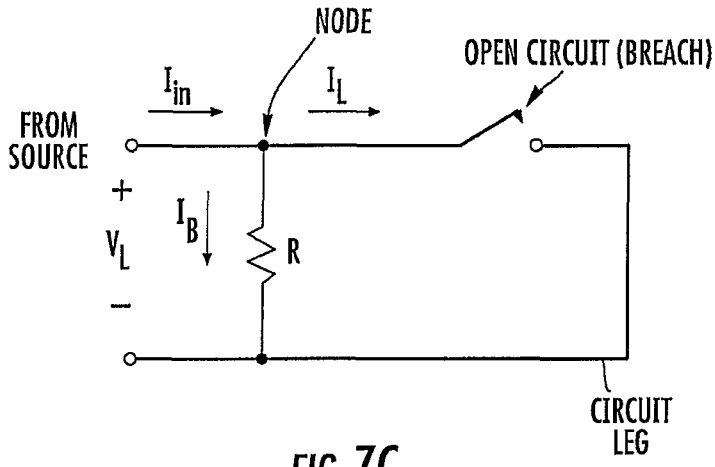
FIG. 7C illustrates a more detailed schematic diagram of one leg of the embedded circuit of FIG. 7B.

A schematic diagram of one of the legs L and its interconnected shunt resistor R is shown in more detail in FIG. 7C. An input current in enters a first node. According to well-established circuit principles, the input current is equivalent to the sum of the currents exiting the node including a bypass current $I_B$ flowing through the bypass resistor and the leg current $I_L$ flowing through the circuit leg L. In a non-breached configuration, the majority of current flows through the circuit leg, such that $I_L=I_{in}$, producing a negligible voltage drop $V_L$ due to resistance of the electrical conductor. However, if the circuit is breached, the current flows through the bypass resistor, such that $I_R=I_{in}$. Consequently, the voltage drop increases according to the value of the bypass resistor ($V=I_{in}/R$). If more than one circuit legs are breached, the measured circuit resistance will vary in relation to the resulting circuit configuration.

In some embodiments, the sensing circuit is embedded within an insulating material forming the panel. Alternatively or in addition, at least a portion of the sensing circuit can be attached to a surface of the insulating material of the panel. Such insulating material can include resin-infused layers of fiber material, such as any of the composite materials described herein. In some embodiments, the panel includes a second insulating material, such as wood.

In some embodiments, the circuit terminals are connected to external electronics for determining the resistance of the circuit. In other embodiments, the circuit includes electronics coupled to the pair of terminals for determining the resistance of the circuit. The electronics can include a signal generator providing an electrical current to the sensing circuit. Alternatively or in addition, the electronics can include a detector for measuring a voltage across the pair of terminals. In some embodiments, the electronics includes a controller for determining a resistance based on the generated current and detected voltage.

One such controller is the 16F684 microcontroller, commercially available from Microchip Technology, Inc. of Chandler, Ariz. The controller promotes low power consumption, requiring approximately 100 microamperes during a reading. The readings can be accomplished in much less than 1 millisecond. In some embodiments, readings are performed at a rate of one per second. The average current is virtually zero.

Alternatively or in addition, the electronics includes a radio transmitter configured to temporarily operate in a low-power "sleep" mode to conserve power. The transmitter can be used to forward reading results from the microcontroller to an external receiver. The electronics optionally include a radio transmitter also configured to temporarily operate in a low-power "sleep" mode. The entire electronics package can be powered using two D-cell batteries, with an expected battery lifetime of about five years or more.

In some embodiments, one or more of the panels are connected to at least one other panel of the same container using jumper leads. For example, one panel including an embedded sensor system and controlling electronics can be electrically connected to another panel through one or more jumper leads. Thus, in some embodiments, electronics in one panel can be used to perform measurements on more than one panel.

Figure 7D:
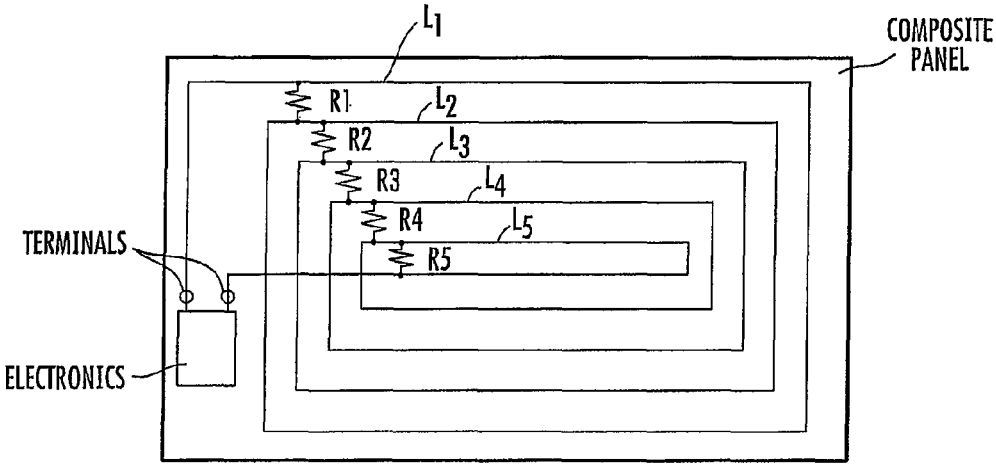
FIGS. 7D-7E illustrate schematic diagrams of various embodiments of a panel each having a different configuration of an embedded circuit including sensors and bypass resistors.

FIG. 7D illustrates another embodiment of a composite panel providing a sensing circuit having a different configuration including multiple interconnected loops L1, L2, L3, . . . (generally L). More specifically, the loops are arranged in a spiral configuration terminating at a pair of circuit terminals. Each loop L extends around the spiral and is interconnected to an adjacent loop by a respective bypass resistor R1, R2, R3, . . . (generally R). Without interruption to the conducting path of the circuit, the majority of current flows through the spiral element, such that a resistance detected at the terminals approximates a short circuit. Interruption of one or more of the loops L; however, results in the loop current flowing through one or more bypass resistors R associated with the interrupted loop(s). Consequently, a circuit resistance measured at the terminals increases from the short-circuit value, depending upon the values of the one or more bypass resistors now carrying current.

The detectability of various sized and shaped panel breaches, or holes, can be controlled to some extent according to a selected configuration, orientation, and spacing of electrically conductive path of the sensing circuit. Referring again to FIG. 7B, a panel breach having a diameter less than the spacing 'd' between adjacent circuit legs may be detected if a portion of the hole coincides with the electrical conductor. However, it would not be possible for such a hole to remain undetected as long as it did not interrupt the electrically conductive path. A panel breach in the form of an elongated hole or slit having a length greater than 'd' may remain undetected if properly aligned between conductive paths.

Figure 7E:
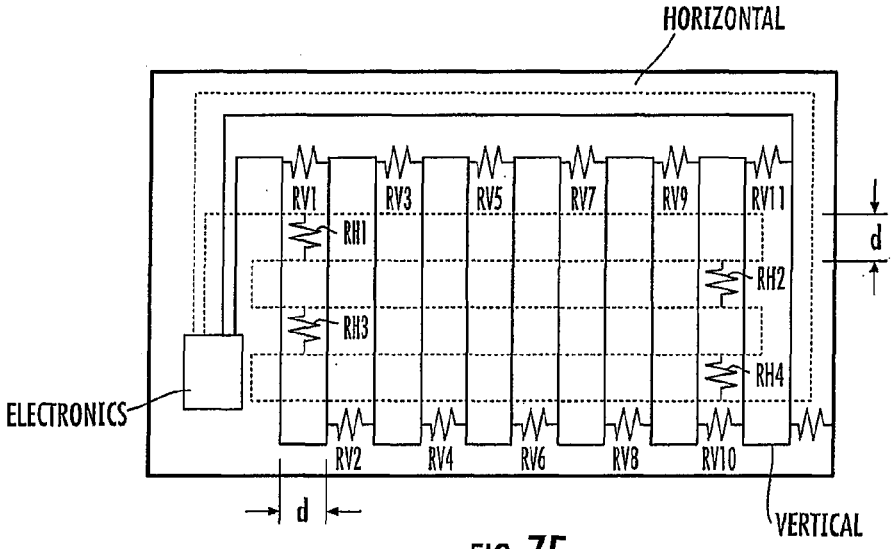

FIG. 7E illustrates an embodiment of a composite panel with yet another different sensing circuit configuration including a horizontally directed serpentine pattern overlaying a vertically directed serpentine pattern. Such a configuration forms a rectangular grid capable of sensing a breach of the panel in more than one direction. Thus, although an elongated breach having a length greater than 'd' may be undetected by one of the two different patterns, it will be detected by the other. In some embodiments, the two patterns are provided between different layers of the resin-infused layers of fiber material providing electrical insulation between the two different patterns.

It would also be possible for a breach or hole having a diameter substantially less than the spacing 'd' to be detected if it happened to coincide with the conductive path, thereby interrupting the flow of current. Consequently, there is no assurance of a minimum-sized detected hole.

Figure 8:
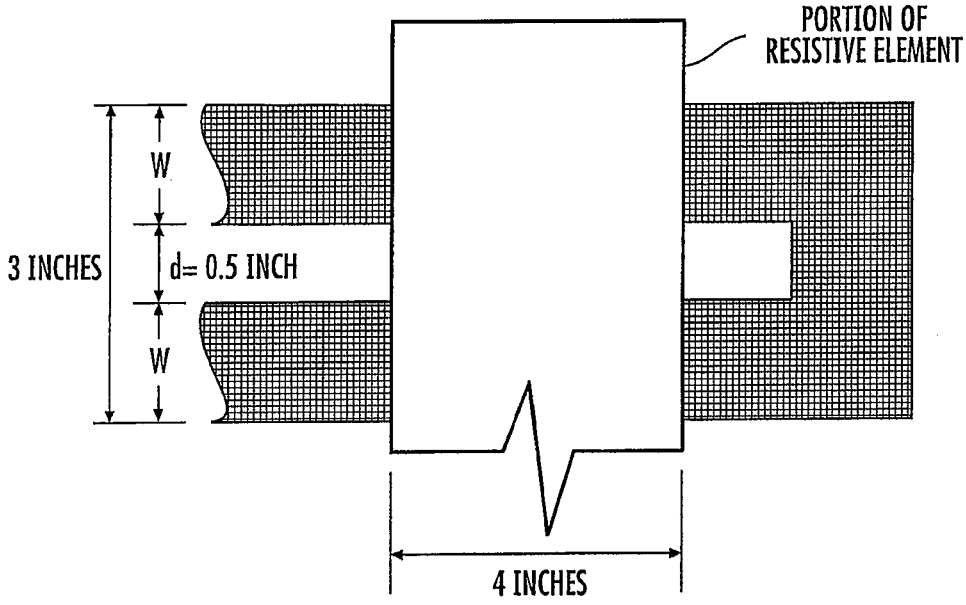
FIG. 8 illustrates a plan view of one embodiment of a circuit element using a wide conductor.

Referring to FIG. 8, an alternative embodiment of a sensing circuit includes an electrically conductive path in which the electrical conductors are formed to have a wide, ribbon-like configuration. As shown, the electrically conductive path is formed using a conductor having a width 'w'. It would be impossible for any panel breach, or hole, having a maximum dimension less than the conductor width 'w' to completely interrupt current flow along any one of the conductive paths. Thus, selection of a conductor width 'w' can be used to eliminate detection of individual holes of sizes less than the conductor width size. In the illustrative example, a conductor having a width of 1.25 inches prevents detection of any holes less than 1.25 inches in diameter.

The distance between adjacent legs of the sensing circuit can also be used in combination with the conductor diameter to set a limit for which a minimum detectable hole size will always be detected. Namely, a hole sized greater than twice the width plus the separation distance "d" between adjacent conductors (i.e., 2 w+d) will always interrupt at least one of the conductors. In the exemplary embodiment, a 3 inch hole will always interrupt at least one of the two 1.25 inch wide conductors separated from each other by 0.5 inches.

The wide conductors can be porous, including openings distributed across the width of the conductor. In some embodiments, the wide conductors are formed from a wire mesh or screen. When used in combination with composite panels, the wide conductors can reside substantially within the composite panel (e.g., between resin-infused layers of fiber material). That configuration is particularly amenable to use in a composite material, as the resin binder can readily permeate the conductive element minimizing any tendency for delamination of a composite panel.

Sensing circuits including wide electrical conductors can also be routed in a variety of configurations and optionally combined with bypass resistors. In some embodiments, the bypass resistors are themselves provided to have a substantial width. Wide bypass resistors reduce the possibility that a panel breach having a hole below the minimum detectable hole size will cause an interruption because it happened to coincide with a narrow bypass resistor. As shown, a bypass resistor having a width of 4 inches can be combined with the exemplary circuit adapted to consistently detect holes equal to or greater than 3 inches, without detecting holes less than 1.25 inches in diameter. Wide bypass resistors can also be provided with an open structure including pores or apertures.

Figure 9:
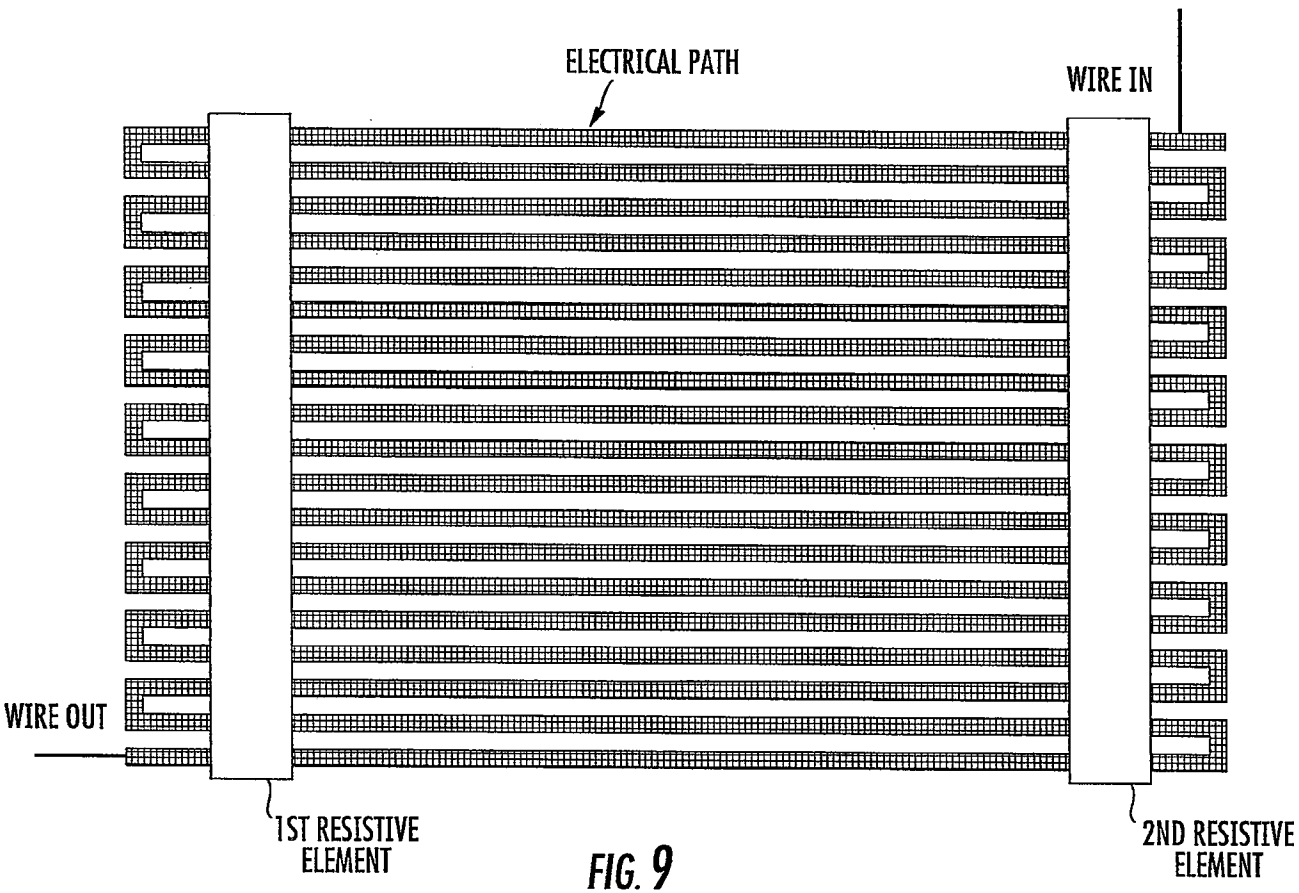
FIG. 9 illustrates a plan view of another embodiment of a panel with an embedded circuit including wide-conductor sensors and bypass resistors.
Figure 10A:
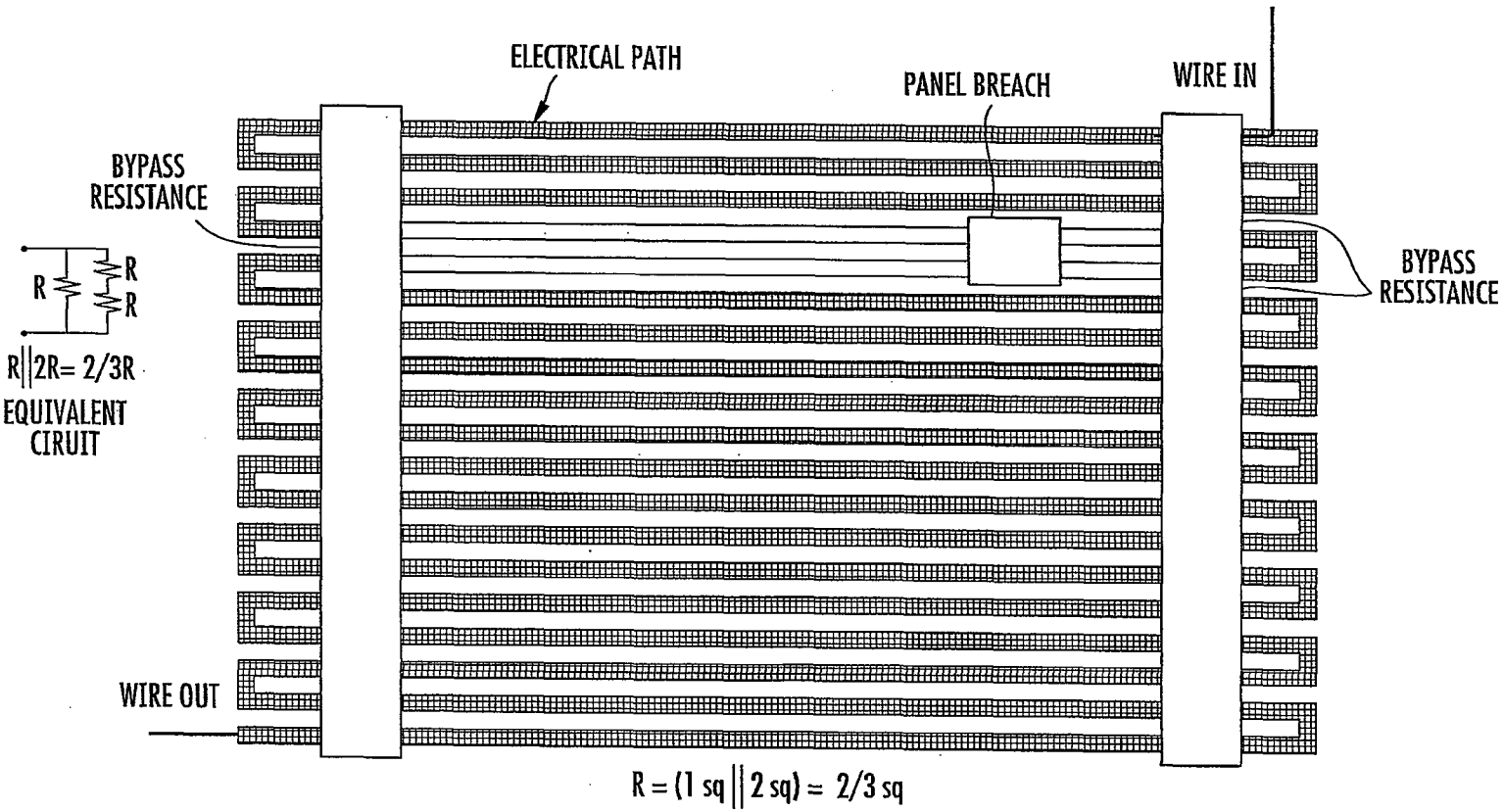
FIGS. 10A-10C illustrate the front panel embodiment of FIG. 9 with holes of various sizes and locations.
Figure 10B:
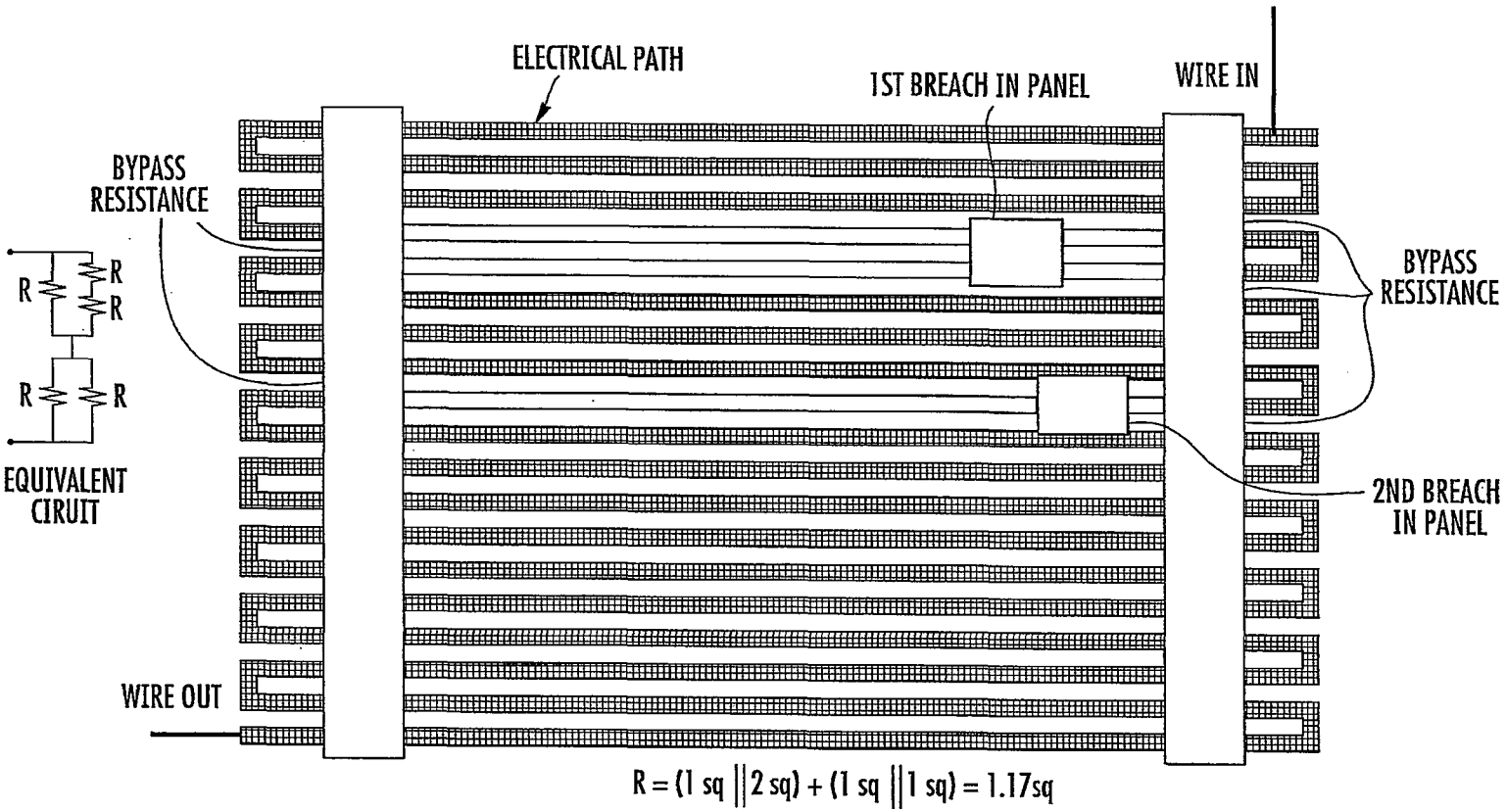

FIG. 9 illustrates an unbroken electrical path having a serpentine configuration and using an electrically conductive screen providing a wide conductor. Two resistive elements are included towards either edge of the serpentine configuration and selectively coupled to one or more of the multiple serpentine circuit legs. In FIG. 10A, a panel breach interrupts two legs of the serpentine circuit. A resulting interruption to current flowing in the effected legs, now open circuited, causes current to flow through the identified bypass resistors. The resulting circuit configuration can be schematically represented as a first resistor shunting a series combination of two other resistors. If all of the resistors are provided with the same resistance R, the effective resistance of the resulting circuit would be ⅔ R. The same circuit is again shown in FIG. 10B with a second smaller hole. The resulting circuit configuration can be schematically represented as the equivalent circuit of FIG. 10A combined in series with a parallel combination of two additional bypass resistors that are associated with the second hole. The effective resistance is 1.17 R.

Figure 10C:
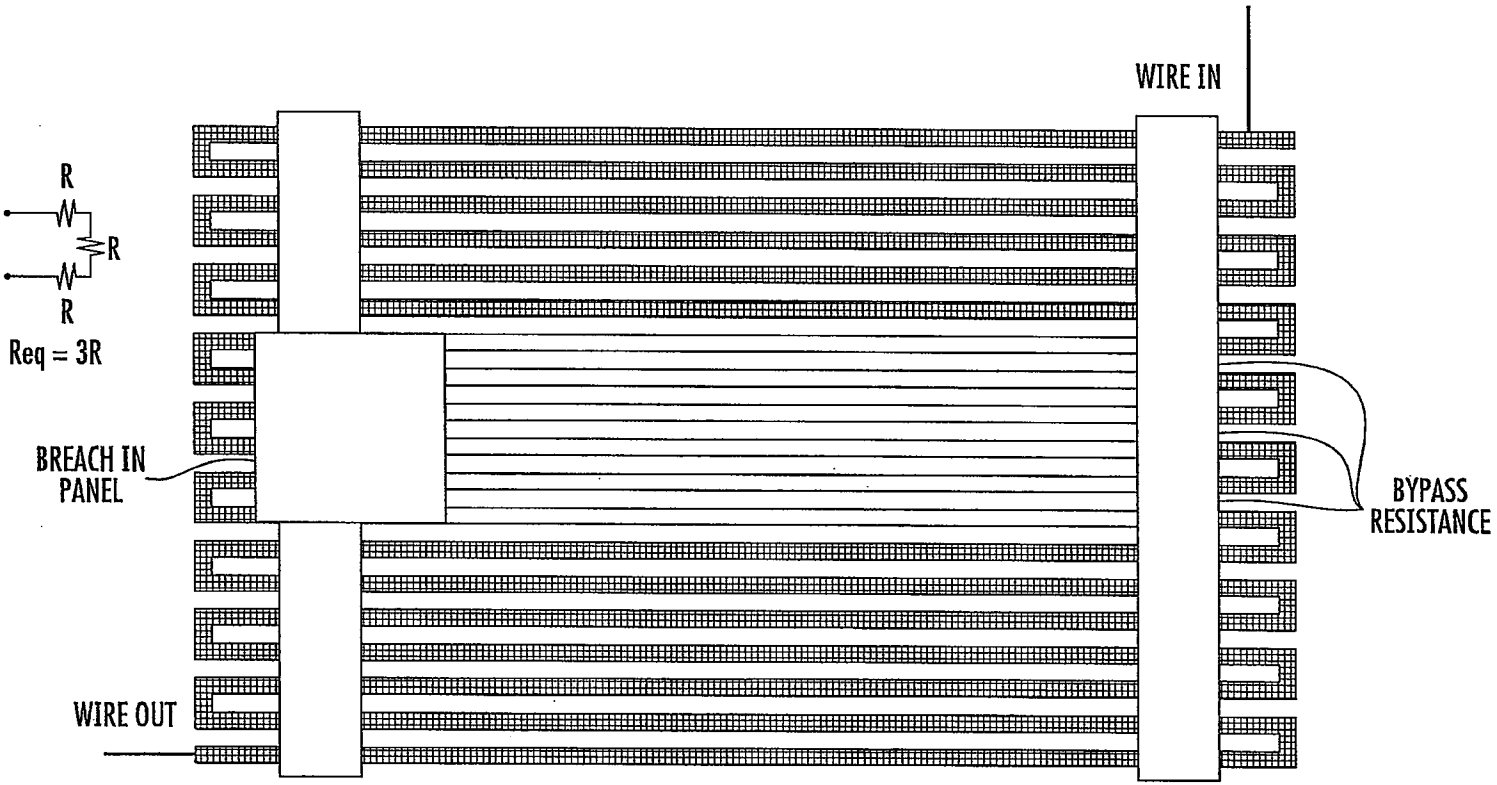

FIG. 10C illustrates the same circuit as in the above examples having a large hole coincident with one of the resistive elements. Current flows in the resulting circuit through three of the bypass resistors on the opposite side of the panel from the hole, resulting in an effective resistance of 3 R. As demonstrated, holes of various size, combination, and location will generally produce different circuit resistance values. This allows for an association of a measured resistance to a hole of a particular size and/or location.

Each conductive element in any of the above embodiments has a respective impedance that is substantially less than a bypass resistor R. For example, the conductive elements are formed from a material generally known as a good electrical conductor. Examples of good electrical conductors include metals, such as copper, aluminum, gold, silver, and nickel; metal alloys, such as bronze; and combinations thereof.

Bypass resistors can include standard carbon-based resistor configurations, such as carbon composition, film, and wire wound resistors, and combinations thereof. In some embodiments, the bypass resistors can include a carbon-based material having a flat, or ribbon-like geometry.

Figure 11:
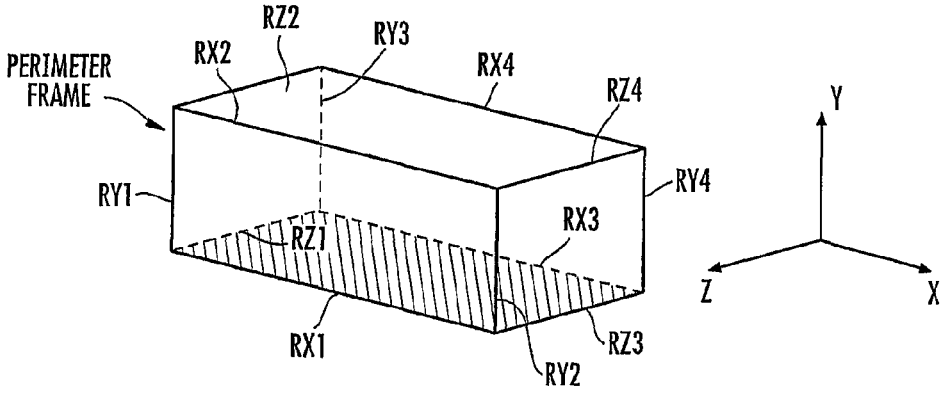
FIG. 11 illustrates a front right perspective view of a container.

The panel of FIG. 1 may be used to form a container 60. In one form, six panels are affixed to a frame 62 such as that shown in FIG. 11. The frame 62 is a rectangular parallelepiped frame composed of a weldable metal, and having four equal length parallel rails RX1, RX2, RX3, and RX4 extending along an X axis. Another set of four equal length parallel rails RY1, RY2, RY3 and RY4 extends along a Y axis. Also, four equal length parallel rails RZ1, RZ2, RZ3 and RZ4 extend along a Z axis, wherein said X, Y, and Z axis are mutually orthogonal. The rails RX1, RX2, RY1, and RY2 define a first side panel locus. The rails wherein RX3, RX4, RY3, and RY4 define a second side panel locus. The rails RY1, RY3, RZ1, and RZ2 define a first end panel locus. The rails RY2, RY4, RZ3, and RZ4 define a second end panel locus. The rails RX2, RX4, RZ2, and RZ4 define a top panel locus. The rails RX1, RX3, RZ1, and RZ3 define a bottom panel locus.

Figure 13:
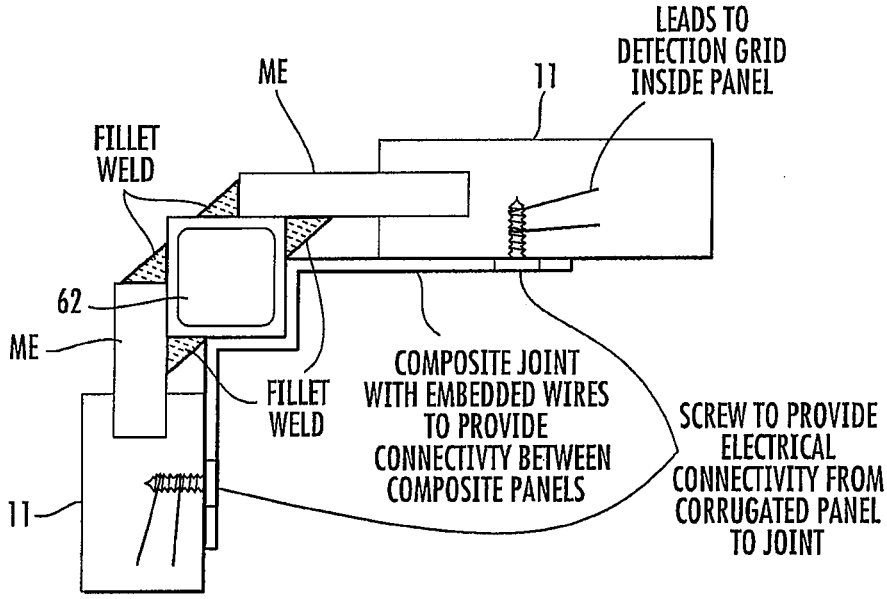
FIG. 13 illustrates a detailed top view of two panels welded to the frame of a container.
Figure 14B:
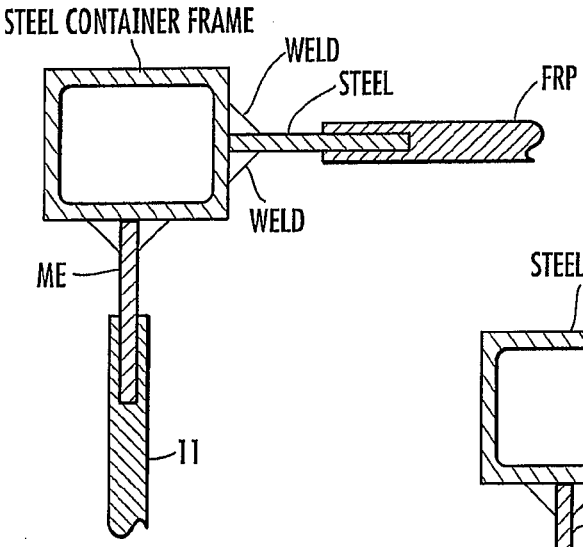
FIG. 14B illustrates a detailed top, cross-sectional view of two panels shown in FIG. 2C welded to the frame of a container.
Figure 14C:
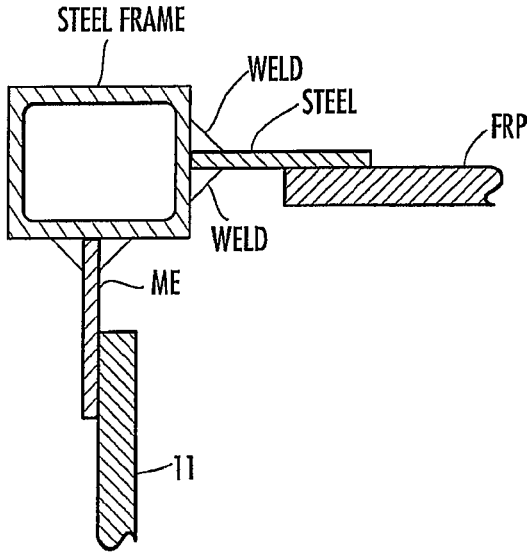
FIG. 14C illustrates a detailed top, cross-sectional view of two panels shown in FIG. 2A welded to the frame of a container.
Figure 14A:
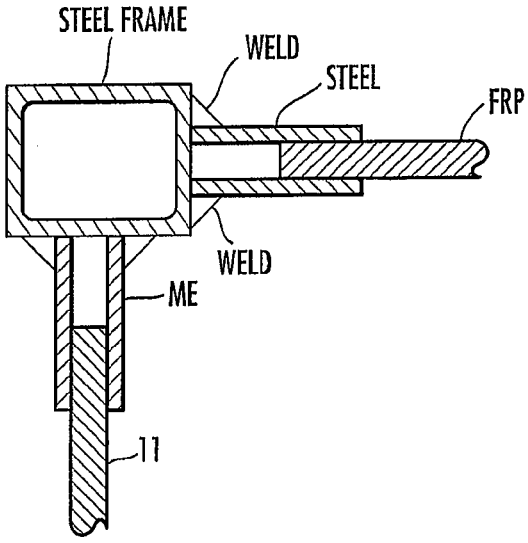
FIG. 14A illustrates a detailed top, cross-sectional view of two panels shown in FIG. 2B welded to the frame of a container.

To construct a container 60 on frame 62, panels of the type shown in FIG. 1 are sized to fit the corresponding loci defined by the frame rails, and welded to those rails of frame 62. For example, a first panel 80 is disposed in the first side panel locus, and welded at its peripheral edge elements ME to said rails RX1, RX2, RY1, and RY2. FIG. 13 illustrates an exemplary welding joint formed between edge element ME and frame 62. That weld extends between the weldable metal that extends from the panels element of the panel. Similarly, a weldable panel is disposed in the second side panel locus and welded at its peripheral edge elements ME to rails RX3, RX4, RY3, and RY4. Another weldable panel is disposed in said first end panel locus and welded at its peripheral edge elements ME to rails RY1, RY3, RZ1, and RZ2. Another weldable panel is disposed in the top panel locus and welded at its peripheral edge elements ME to rails RX2, RX4, RZ2, and RZ4. The container may further include another weldable panel disposed in the bottom panel locus and welded at its peripheral edge elements ME to rails RX1, RX3, RZ1, and RZ3. Alternatively, hybrid reinforced wood panels may be fastened to the floor joists using conventional mechanical fasteners used in existing construction of floors. A container further includes a weldable panel disposed in second end panel locus and welded at its peripheral edge elements ME to rails RY2, RY4, RZ3, and RZ4. Any one or more, of the panels can alternatively be hingedly coupled to the frame to form a door for the container. Exemplary welding joints between the panels of FIG. 2B and a steel frame are shown in FIG. 14A; between the panels of FIG. 2C and the steel frame are shown in FIG. 14B; and between the panels of FIG. 2A and the steel frame are shown in FIG. 14C.

In one arrangement, a composite container is constructed to have a shape and size similar to a standard steel shipping container so that the composite container can be used interchangeably with conventional steel shipping containers. In this case, the perimeter frame is made of typical steel members used on conventional ISO steel shipping containers. Composite containers of the invention may be stacked and loaded similar to conventional steel containers, using conventional loading equipment.

Figure 12:
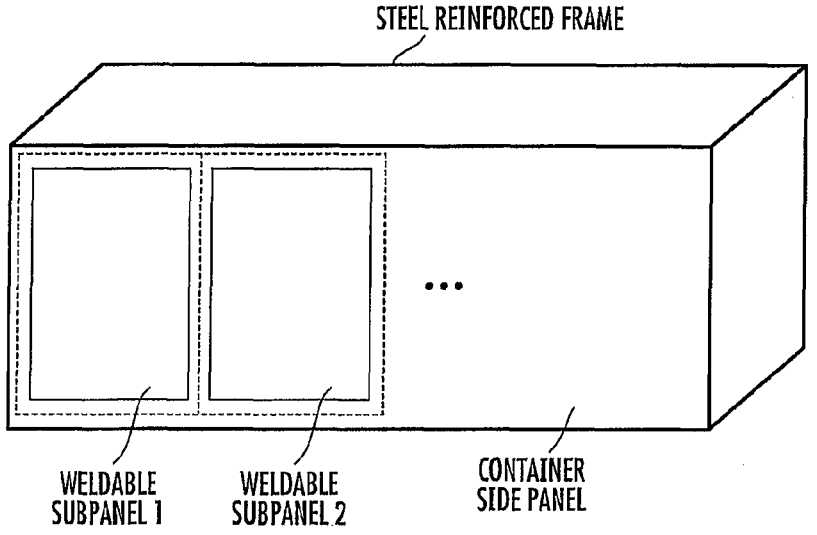
FIG. 12 illustrates a front right perspective view of a container including weldable composite sub-panels.

In some embodiments, two or more weldable sub-panels can be combined, such that the combination is sized to fit the corresponding loci defined by the frame rails. As shown in FIG. 12, multiple weldable sub panels are combined along a common side panel of a standard shipping container. The use of sub panels can simplify sparing, as spared components can be smaller in size. Alternatively or in addition, the use of sub panels can reduce maintenance costs as damage can be corrected using smaller panel segments.

Figure 12A:
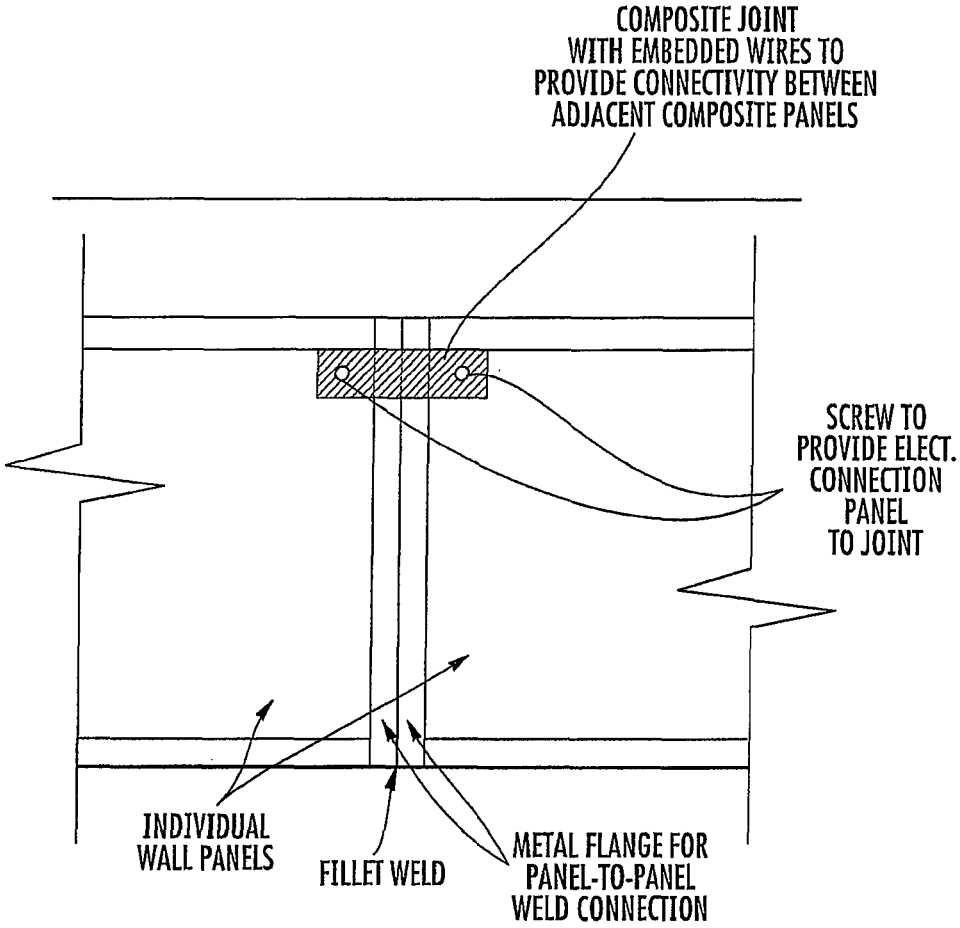
FIG. 12A illustrates a plan view of two adjacent composite subpanels joined together and including a jumper for electrically interconnecting embedded conductors of the adjacent subpanels.

A groove and flange design may be incorporated in the container panels to provide electrical power and data paths which will interconnect stack containers, allowing communications amongst and between the containers, and in some cases, establishing a network. Alternatively or in addition, a jumper can be used to interconnect embedded conductors of different composite panels. An exemplary embodiment is shown in FIG. 12A including a jumper provided between adjacent subpanels. The two subpanels are joined with a fillet weld along adjoining metal flanges providing a panel-to-panel connection. A jumper is used to span the joint. The jumper is connected at either end to a respective embedded conductor within each of the adjoining subpanels. In some embodiments, screw terminals are provided on the subpanel providing access to the embedded conductors. Thus, a conductive jumper interconnects the embedded conductors by simply connecting to the exposed screw terminals of a pair of adjacent subpanels.

In some embodiments, a composite joint is formed along respective edges of two adjoining subpanels. The composite joint includes embedded wires that can be used to provide connectivity between the adjacent panels. A conductive element, such as a jumper spanning the composite joint can be screwed into each of the adjacent subpanels, thereby providing a connection from the panel to the joint.

A single assembled container may be positioned and connected to a container rack. In some arrangements the rack may be connected to a PC or other similar digital device that is capable of accessing the Internet. Along with supplying Internet access, rack may also supply power to the container (along with other containers). By connecting the container (or containers) to a rack, signals and/or messages that represent a container condition (e.g., the status of the container) may be sent to a remote computer system or server.

Along with sending information to remote locations, components may be embedded in the panels of a container for storing the information for later retrieval. Furthermore, information may be uploaded to the assembled container under control of a remote server. As mentioned above, individual CPLDs may be embedded in panels, and these CPLDs may be used to inexpensively implement relatively high data rates with interfaces implementing one or multiple protocols.

The sensor arrays in the panels of the invention are configured so that a hole on any of the six faces of the container larger than a predetermined detectable size, for example, 9 square inches, can be detected immediately when the hole is cut under circumstances of light or darkness and under any loading condition. Also, conductive serpentine grid bonds with widths of at least about 18 inches prevent false positives so that holes of sizes less than 9 inches do not alarm the system.

In an alternative form, the container wall contains plugs through which processors and other sensors can be coupled, thereby providing a completely modular approach that can be upgraded as new technology becomes available. The processor or processors, using modular standard interfaces manage the sensors, alerting, external communications, and security functions.

In one arrangement, the container system is provided with a security system designed on the assumption that the container may be in the physical possession of criminals or terrorists or other persons with hostile intent. This level of security substantially exceeds security based on the assumption that outsiders are attacking a safe interior core. In one example the security system includes software, cryptographic tokens, and other types of data that may be securely provided from a remote monitoring station.

Composite container may include other sensors for detecting the opening of one or more doors, movement, extreme environmental conditions, seal status, and other conditions that may be of interest to a customer. In one arrangement, the sensors are embedded in the panels. Alternatively, the sensors may be attached to or plugged into the panels and may be removed from the walls. The composite containers also can be provided with RFID tags and/or RFID monitoring devices or other similar systems.

The sensors and processors in composite container may be further capable of detecting a breach of any of the six walls of the container under any load conditions. The anti-breach system can be tuned to a point where the rate of false positives is acceptably low by using wide bypass resistors and wide conductive grid bands. Embedding the sensors and processors in the container walls also protects the sensors and processors both from sabotage and from the harsh maritime environment when the containers are in use. In one arrangement, the composite container walls are provided with a modular design with attaching means, for example, holes, so that additional equipment (e.g., sensors and or processors) can be rapidly and easily attached to or plugged into the walls, to account for the development of new technologies and/or to configure the container for a specific type of cargo or a specific situation. For example, an empty container might need simpler, less expensive instrumentation than a container full of cargo.

The embedded power and data paths inside the containers preferably are accessible from external sources via inductive couplings, allowing for (a) recharging the power (batteries), (b) forming hard wired data and electrical paths, and (c) building a communication network within a stack composed entirely of composite containers, which can be used to count the number of the containers and detect the interposition of rogue containers in the stack. The security system may enable the automatic installation of different software modules immediately before a container is loaded and the use of several processors inside the container, which continuously check on one another and provide status and feedback information.

The container, in some examples, is an integral unit that includes four walls (a front wall, two end or side walls, and back wall), a roof (or top), a floor (or bottom). In one embodiment, the container has at least one door. According to another embodiment, the container preferably has at least two doors and one end. Again, in one arrangement, the doors include a coupling that permits the flow of optical and electrical data and electrical power to and from the doors. Additionally, or alternatively, a similar coupling may be used on the bottom of the container to permit the flow of optical and electrical data and electrical power to or from a similar (or complementary) coupling on the top of an adjacently positioned container, for example, or from a rack on which containers are stacked, or from a truck chassis on which a container is placed. Again, additionally, or alternatively, the adjacent complementary couples permit optical and/or electrical signal flow between and through various containers in a stack.

The data coupling incorporates a coupling mechanism that, if needed, withstands the harsh rigors of the maritime environment, where heavy containers may be stacked on top of one another and on truck chassis by crane. In an alternative embodiment, electrical couplings transferring power to a container by inductance is used with the container. Data is modulated over such a coupling to provide a data transfer method. For the door, optical signals/data can be coupled through butt joints of fiber optical paths, for example, or by effervescent light coupling.

In some arrangements, detectors for sensing special nuclear materials may be embedded into the composite panel walls. For example, relatively inexpensive domestic sensors may be embedded. In some conventional systems, special nuclear materials may be shielded. However, for sufficiently small container sizes, shielding may be impractical. In contrast, an appropriate number of small individual containers with embedded domestic sensors may provide a useful strategy for reducing the risk of nuclear weapons being imported through a maritime transport. Under this strategy, shipments that contain cargo in volumes that might be feasible for adequate shielding or special nuclear materials may need special handling.

In another application, after contents have been placed in a container, the container may be locked and sealed under control of a remote server. During this procedure, cryptographic material, randomly produced by the remote server may be uploaded into the container and stored in an appropriate FPGA or CPDL device embedded in one or more of the container walls.

When an unauthorized condition occurs, such as a breach of the container wall or an unscheduled opening of the container, the intrusion may be sensed by the embedded sensors internal of the container and embedded cryptographic material is partially or completely destroyed. Due to this procedure, an adversary may be unable to restore cryptographic material or determine the state of the container prior to the intrusion. Additionally, a signal or message may be sent to a remote server to indicate that an alarming condition has been detected. In some scenarios, the remote control server may ask for a hash of the previously supplied cryptographic values, to which, if an alarm has occurred, the container may be unable to supply that information.

Referring back, each individual container may include slots that are capable of receiving fork lift tongs so that the containers may be moved individually or as a stack. Since, as mentioned above, the contents and condition of a container or a stack of containers may be queried by a remote computer system via an embedded or attached data interface, containers and stacks of containers may be moved and inventoried while being monitored.

Other types of sensors and detectors may be incorporated into a container or a stack of containers. For example, a sensor may be included that determines the weight of the container and store data that represents this weight. Alternatively, a previously sealed container may be weighed by a separate device, and this information may then be stored in the container. Additionally, information such as data from domestic sensors, weight information, the supposed contents of the container, etc. may be fused together and processed to develop a metric to identify the likelihood that the container contains a nuclear device or other harmful contraband.

In general, commerce flows in world commerce are typically uneven, with more goods flowing in one direction than another. Consequently, the capability to ship disassembled containers is vital. Thereby, in some arrangements individual panels with embedded sensors may be shipped to particular locations (e.g., shipping ports, airports, etc.) for assembling at a later time. Since individual panels may be shipped separately, prior to assembling containers, the individual panels may be inserted into a rack for testing (e.g., pass a check-out procedure) by a remote server to determine if the panel is functioning correctly. Furthermore, composite containers may be partially or completely assembled in a rack for testing by a remote computer system to determine if the container is functioning properly.

A container rack may be implemented for various platforms and facilities. For example, a container rack may be designed and produced for positioning on truck chassis, a ship cargo compartment, a factory floor, etc. so that monitoring may continue during loading and off-loading periods and during transit. To provide power during these periods, the container rack may be designed to supply power (along with data connectivity) to a stack of containers (e.g. a stack of eight containers) that is held by the rack.

In some arrangements, a container that is produced from composite material may be produced in which the sides, the roof, the floor, the front and back, and doors may be disassembled into panels and reconstructed as needed. By manufacturing and distributing panels produced from composite material, the panels may be easily assembled at a shipping site into an appropriate container size. This container, once assembled, may be lighter than a similar container made of steel and may have more strength. Additionally, the container may be able to withstand the elements of a marine environment, and may be cost competitive.

In some arrangements, multiple composite containers may be vertically stacked so that an upper-positioned container securely mates with the container located directly below. By mating containers, a portion of a stack or a complete stack of containers may be lifted and moved as a single unit. This design has the advantage of reducing the cost of shipping empty containers back to the point of origin, because the disassembled parts are more compact for shipping purposes than the empty containers. This also reduces the risk of terrorists and other adversaries hiding people or contraband in empty containers. Another advantage is that refurbishment and maintenance is possible at the panel level rather than the container level. Discrete panels can be employed or not, depending on a user's desire to trade off advantages and disadvantages, such as a container made this way might not be as strong as a container manufactured as a unit, and the additional complexity of interfacing the electrical, optical, and power paths through walls composed of separate panels, and that such a device might be more easily reverse engineered by an adversary.

In some arrangements, the composite container may include an embedded wireless fidelity (WIFI) device that is capable of communicating externally without needing to rely on optical and electrical coupling. Furthermore, in some arrangements, the composite container includes an embedded telecommunication device (e.g., a radio frequency transceiver) for communicating with a loading crane and/or other ground- (or terminal-) based equipment.

According to another preferred embodiment, the sensors and processors of a stack of composite containers are interconnected and a data path and optionally an electrical path is formed by the interconnected containers, so that a system that includes the stacked composite containers is able to count the number of containers and detect the interposition of a rogue container that lacks conforming communication information and status information from that container, aid distribute electrical power to other containers as well.

According to another arrangement, the sensors and processors of multiple composite containers, which are stored in a stack, are interconnected and a data path is formed by the interconnected containers, so that a system that is formed by the sensors and processors of the stacked composite containers. This system of sensors and processors is able to count the number of containers and detect interposition of a rogue container that lacks conforming communication information and status information of the processors and sensors from that container. In another embodiment, the interchangeably conventional steel containers are provided with communication links and/or sensors and or processors, so that in a stack of containers, which includes both the composite containers and the steel containers, the steel containers can intercommunicate with the composite containers, and the composite containers and the steel containers form a communication network.

In some arrangements, two or more of the containers in a container stack are interconnected and thus form a communication network, which may be capable of counting the number of the containers and detecting the unauthorized inserting of a rogue container into a stack of containers on a platform such as a ship.

Composite containers (assembled above) may be vertically stacked upon one another. In some arrangements, an assembled container may mate with a container positioned below by using the flange and groove design described above. By mating the stacked containers, power and/or data connections may be made between the containers so that power and/or information may be passed among hardwire or wireless paths that interconnect the stacked containers.

A rack of stacked containers is shown in which each container is connected (directly or indirectly) to one or more remote servers (via the Internet) for sending and/or receiving information. In one scenario, this exemplary arrangement may be used to monitor the interposition of rogue containers in a stack of containers. Rogue containers are containers that are not remotely controlled, and, for example, may contain contraband such as nuclear weapon or toxic material. In some arrangements, a stack of containers and a rack may be designed to fit into a twenty-foot or forty-foot ISO shipping container. In this illustrative example, the containers are approximately four feet high so that a stack of two containers plus rack may be inserted into a ten-foot high ISO container. If a rogue container, which is not connected to a remote server, is inserted into or positioned on top of the stack, the entire stack may not fit in the ISO container and thereby be detected. If a rogue container is interchanged with a container in the stack, due to absence of a connection with the remote server, the server may determine the presence of the non-conforming container.

For a stack of ISO containers, the interposition of a non-conforming container into the middle of the stack may be relatively quickly detected by a remote controller that is connected to the stack through the Internet. Detection of a rogue container placed on top of the stack may be detected by incorporating a device (e.g., pressure sensor) that is connected to the stack and detects any non-conforming device placed on top of the stack. In other arrangements, this capability may be incorporated into the top side of composite containers used to in place of the conventional ISO shipping containers.

Figure 15:
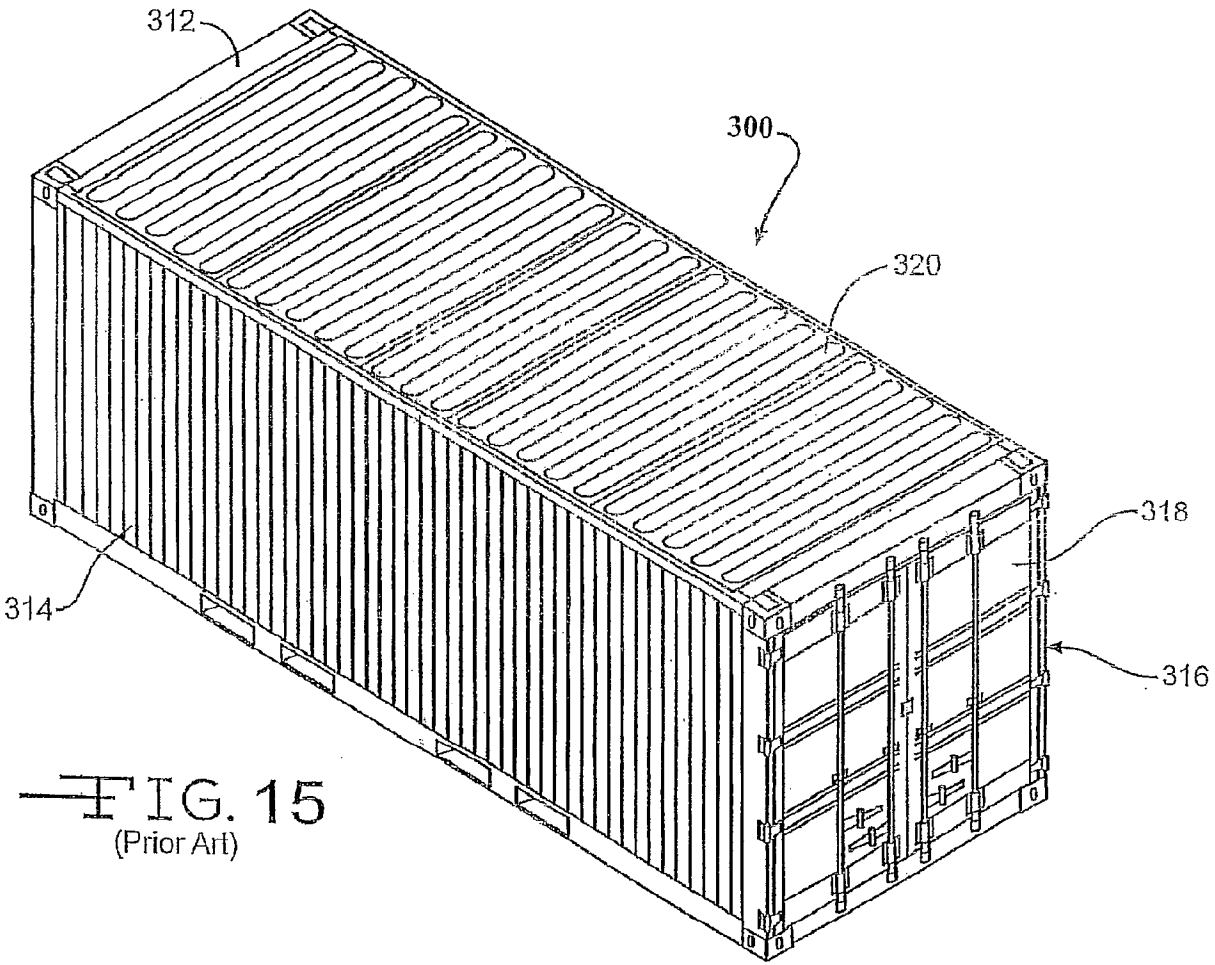
FIG. 15 (Prior Art)
FIG. 15 is a perspective view of a known shipping container.

Referring now to FIG. 15, there is illustrated generally at 300 a known shipping container. The shipping container 300 includes a known load-carrying element or frame 312, typically formed from steel. The frame 312 typically supports side walls 314, a first or closed end wall (not shown), an second end wall 316 including at least one door 318, a floor (not shown), and a roof 320. The side walls 314, end wall, and roof 320 are typically formed from corrugated steel.

Figure 16:
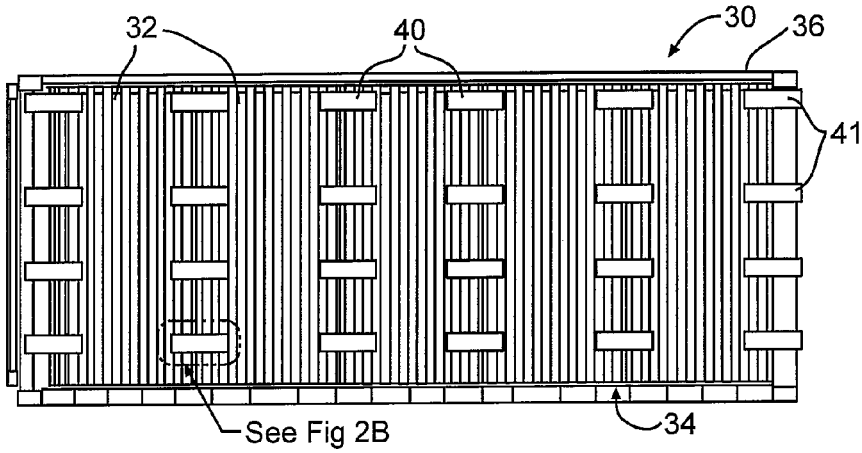
FIG. 16 is a side elevational view of a shipping container showing a first embodiment of a breach detection system according to the invention.

Referring now to FIG. 16, there is illustrated generally at 30 a shipping container formed of panels 32 mounted to a shipping container frame, such as the frame 312 shown in FIG. 15. The panels 32 may be any of the embodiments of composite panels described above, as well as the embodiments of the composite panels described below. Each panel 32 includes an electrical circuit comprising the array, pattern, or grid of electrical conductors and resistors as disclosed above. Alternatively, each panel includes the electrical circuits described below. The electrical conductors and resistors may be attached to, or embedded within the composite panel 32 to form an electrical circuit. As best shown in FIG. 16B, each side of the panel 32 includes an edge element 31 formed from a weldable material such as steel. In the embodiments of the panels described in detail below, the electrical circuit includes panel electrical access points, described below, to allow for external monitoring of the circuit, and to allow for electrical connection between panels 32.

In the embodiment illustrated in FIG. 16, a side wall 34 of the shipping container 30 is formed from a plurality of the panels 32 welded to the container frame 312 and to adjacent panels 32. A roof 36 and a floor (not shown) of the container 30 may also be formed from a plurality of panels 32 welded to the container frame 312 and to adjacent panels 32. It will be understood however, that the payload-bearing floor 38 may be formed from an alternative panel (not shown) having increased strength or load-bearing properties, such as the hybrid wood-composite panel disclosed above.

The embedded electrical circuits of adjacent panels 32 may be connected by a jumper or connector 40, described in detail below. Alternatively, the embedded electrical circuits of adjacent panels 32 may be connected by any of the connectors 50 and/or 60, also described in detail below. Generally, the connectors include a connector body formed from composite material, such as the composite material used to form the panels 32, plastic, or rubber. Each connector includes an array, pattern, or grid of electrical conductors attached to, or embedded within the connector body to form an electrical circuit. Such connectors provide built-in impact resistance, increased durability, and tampering protection. In the embodiments of the panels described in detail below, the electrical circuit includes connector electrical access points to allow for external monitoring of this circuit, and to allow for electrical connection to the panel electrical access points of the panels 32. As shown in FIG. 16, any desired number of connectors may be provided between adjacent panels.

Figure 16A:
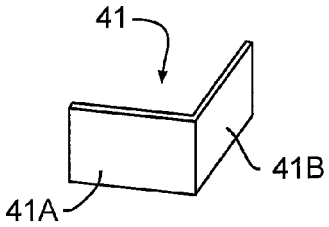
FIG. 16A is an enlarged perspective view of the corner connector illustrated in FIG. 16.
Figure 16B:
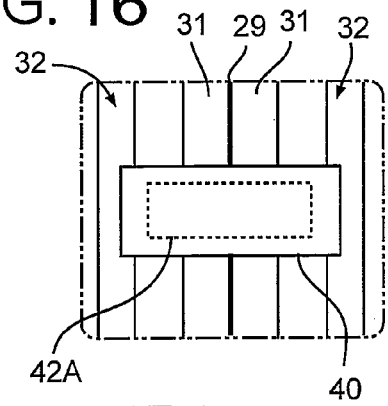
FIG. 16B is an enlarged view of the portion of the shipping container within the circle 2B of FIG. 16.

As best shown in FIG. 16A, a corner connector 41 may be provided to connect panels 32 on adjacent walls of the shipping container 10. In the illustrated embodiment, the corner connector 41 includes a first portion 41A and a second portion 41B disposed at an angle of about 90 degrees.

Because the metal edge elements 31 of the panels 32 are not part of the electrical circuit defined by the panels 32 and the connectors 40, the edge elements 31 may be vulnerable to an attempt to breach the container 10. Advantageously, any attempt to breach the shipping container 10 by cutting along the weld (such as the weld 29 illustrated in FIG. 16B) between adjacent panels 32, or through the metal edge elements 31, will require cutting through at least one connector 40. Cutting, drilling through, or otherwise breaking the electrical circuit embedded within the connector 40 and electrically connected to the electrical circuit embedded within one or more panels 32, disrupts the electrical circuit and alerts a local and/or remote system monitor that someone has attempted to breach or tamper with the container 32.

Figure 17:
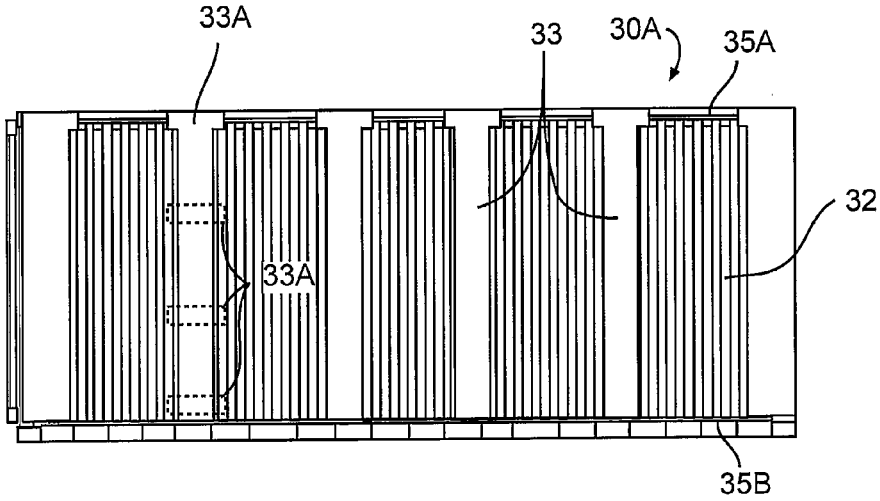
FIG. 17 is a side elevational view of a shipping container showing a second embodiment of the breach detection system illustrated in FIG. 16.

A second embodiment of the shipping container is shown at 30A in FIG. 17. Elongated connectors 33 extend from a first or upper end 35A to a second or lower end 35B of the panel 32, and include an electrical circuit as described above. An upper end of the connector 33 defines a substantially rectangular connector portion 33A.

In the illustrated embodiment, the connector portion 33A may be substantially identical to any of the connectors 40, 50, and 60, described below. The connector portion 33A provides an electrical connection between adjacent panels 32. If desired, adjacent panels 32 of the shipping container 30A may be connected by a plurality of additional connector portions 33A, as shown by the connector portions 33A illustrated by phantom line in FIG. 17.

Advantageously, the connectors 33 substantially cover the metal edge elements 31 of the panels 32. It will be understood that by substantially covering the metal edge elements 31 with the connectors 33 containing an electrical circuit, an area vulnerable to a breach attempt may be substantially eliminated.

Figure 18A:
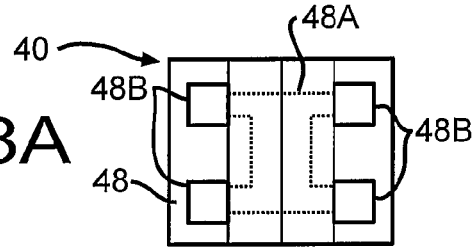
FIG. 18A is a plan view of a first embodiment of a connector shown in FIG. 16.
Figure 18B:
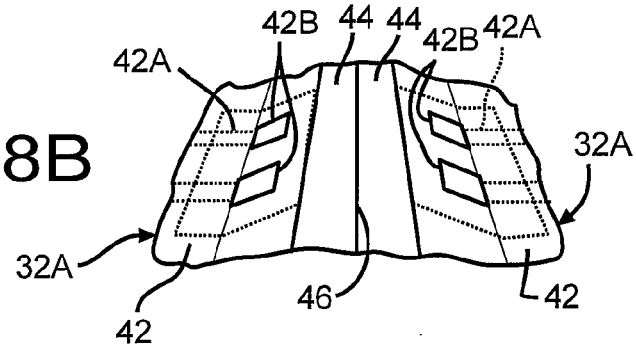
FIG. 18B is a perspective view of a portion of a first embodiment of a wall of the container shown in FIG. 16.

A first embodiment of a connector 40 and an associated first embodiment of the shipping container panel 32A are illustrated in FIGS. 18A and 18B, respectively. FIG. 18B illustrates portions of two corrugated panels 32A having a composite body 42 and a steel edge element 44. The body 42 further includes a first electrical circuit 42A embedded in the body 42. The adjacent edge elements 44 are joined together at a welded seam 46. The first electrical circuit 42A includes panel electrical access points 42B.

The illustrated connector 40 includes a connector body 48. The connector body 48 is substantially rectangular and has a surface shape corresponding to the corrugated shape of the joined panels 32A. The connector body 48 includes a second electrical circuit 48A embedded in the body 48 and connector electrical access points 48B.

The connector 40 may be mounted to the panels 32A such that the panel electrical access points 42B engage the connector electrical access points 48B to complete an electrical circuit between adjacent panels 32A. The connector 40 may be attached to the panels 32A by any desired means, such as with adhesive. Alternatively, the connector 40 may be attached to the panels 32A with mechanical fasteners, such as the fasteners illustrated in FIGS. 19A and 19B.

Figure 19A:
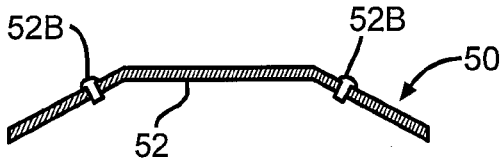
FIG. 19A is an end view in section of a second embodiment of the connector shown in FIG. 16.
Figure 19B:
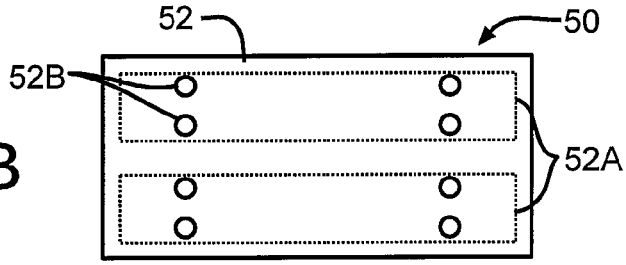
FIG. 19B is a plan view of the connector shown in FIG. 19A.

A second embodiment of a connector is illustrated generally at 50 in FIGS. 19A and 19B. The connector 50 includes a connector body 52. The connector body 52 is substantially rectangular and has a surface shape corresponding to the corrugated shape of the joined panels 32A. The connector body 52 includes a second electrical circuit 52A embedded in the body 52 and connector electrical access points 52B. In the illustrated embodiment, the connector electrical access points 52B are mechanical fasteners. The fasteners 52B may be any desired fastener such as threaded fasteners or rivets. The connector 50 may be mounted to the panels 32A such that the fasteners 52B engage corresponding openings (not shown) in the panels 32A.

Figure 20:
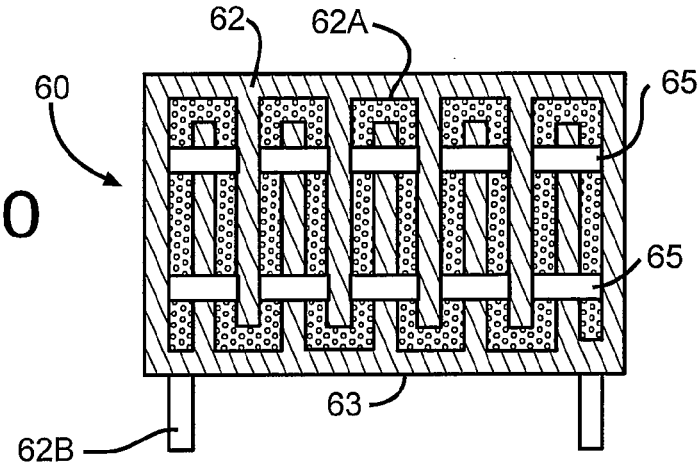
FIG. 20 is a plan view in section of a third embodiment of the connector shown in FIG. 16.

FIG. 20 is a plan view in section of a third embodiment 60 of a connector. The connector 60 includes a connector body 62 shown in section to expose an embodiment of the embedded second electrical circuit 62A. The connector body 62 is substantially rectangular and may have any desired surface shape corresponding to the shape of the shipping container panels to which the connector 60 will be attached. The connector body 62 includes the second electrical circuit 62A embedded in the body 62 and connector electrical access points 62B. In the illustrated embodiment, the connector electrical access points are metal tabs 62B extending outward of a peripheral edge 63 the connector body 62. The tabs 62B may be any desired shape and size and are structured and configured to engage corresponding panel electrical access points (not shown in FIG. 20), such as the panel electrical access points 42B illustrated in FIG. 18B. The tabs 62B may be formed from any desired conductive material, such as copper, aluminum, or steel.

The circuit 62A is formed in a substantially serpentine path or pattern with a plurality of resistors, shown schematically at 65, spaced apart along the substantially serpentine path of the circuit 62A. In the illustrated embodiment, the circuit 62A is formed from perforated aluminum foil. Alternatively, the circuit 62A may be formed from any other perforated or non-perforated metal foil, vapor deposited metals, and any other conductive material. The resistor 65 may be formed from any desired semi-conductive material, such as conductive resin, conductive paint, and conductive rubber. It will be understood that the circuit design as shown at 62A could be applied to any of the embodiments discussed above.

Figure 21:
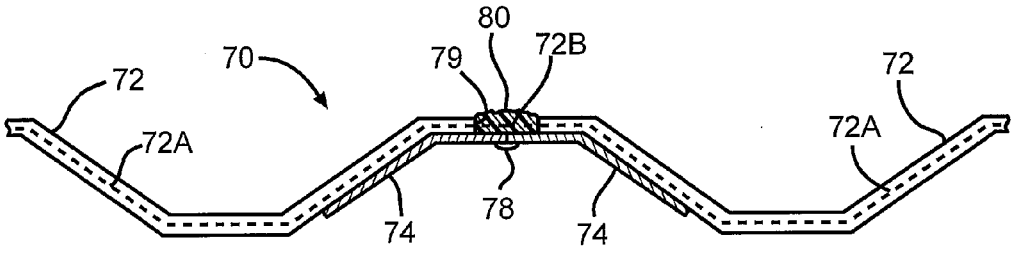
FIG. 21 is an enlarged schematic end view in section of a portion of a second embodiment of the wall of the container shown in FIG. 16.

A second embodiment of the shipping container panel 70 is illustrated in FIG. 21. FIG. 21 shows a panel-to-panel connection and illustrates portions of two corrugated panels 70 having a composite body 72 and a steel support and edge element 74. The edge elements 74 of adjacent panels 70 are joined together at a welded seam 78. The composite body 72 further includes a first electrical circuit 72A embedded in the body 72. The electrical circuit may be any of the configurations of electrical circuits discussed above.

A space between the adjacent panel bodies 72 defines a channel 79. Any desired connector 72B may be mounted within the channel 79 to connect the first electrical circuits 72A of the adjacent panel bodies 72. It will be understood that the electrical connector 72B may be any electrical connector such as the connectors 40, 50, and 60 described in detail above. Alternatively, any other desired electrical connector may be used to connect the first electrical circuits 72A of the adjacent panel bodies 72. If desired, the channel 79 may be filled with a protective material 80. Advantageously, the protective material 80 protects the edge elements 74, welded seam 78, and electrical connector 72B from tampering and damage that may occur from impact. Examples of suitable protective material 80 include rubber, and materials typically used to line truck beds, such as polyurea. Alternatively, any material that forms a durable, water and air-tight, abrasion resistant layer that protects from impact and abrasion, may be used.

Figure 22:
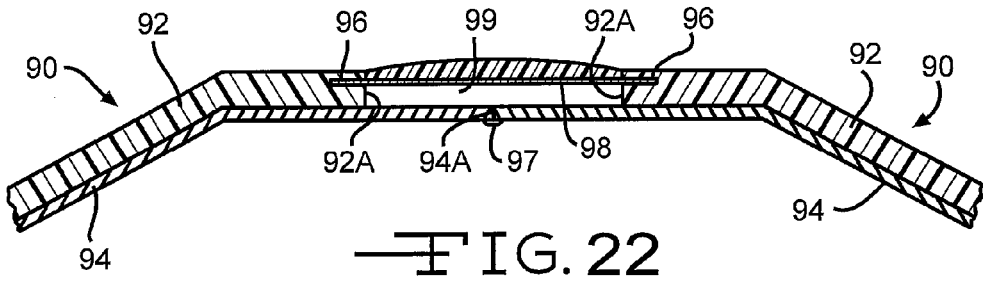
FIG. 22 is an end view in section of a third embodiment of the wall of the container shown in FIG. 16.

A third embodiment of the shipping container panel 90 is illustrated in FIG. 22. FIG. 22 shows a panel-to-panel connection and illustrates portions of two corrugated panels 90 having a composite body 92 and a steel support and edge element 94. The composite body 92 further includes a first electrical circuit (not shown) embedded in the body 92. The composite body 92 also defines a longitudinally extending edge 92A. An elongated slot 96 is formed in the edges 92A of the composite body 92.

The illustrated support and edge element 94 has a surface shape corresponding to the shape of the composite body 92. In the illustrated embodiment, the composite body 92 is corrugated. The support and edge element 94 defines a longitudinally extending edge 94A which extends outward from the longitudinally extending edge 92A. The edges 94A of adjacent panels 90 are joined together at a welded seam 97. An elongated plate 98 is mounted within the slots 96 of the adjacent composite bodies 92 and defines an elongated cavity 99.

Any desired connector, such as the connectors 40, 50, and 60 described in detail above, may be mounted within the cavity 99 to connect the first electrical circuits of the adjacent panels 90. Alternatively, any other desired electrical connector may be used to connect the first electrical circuits of the adjacent panels 90. If desired, the protective material 80 may be applied to an outwardly facing surface of the plate 98.

Figure 23A:
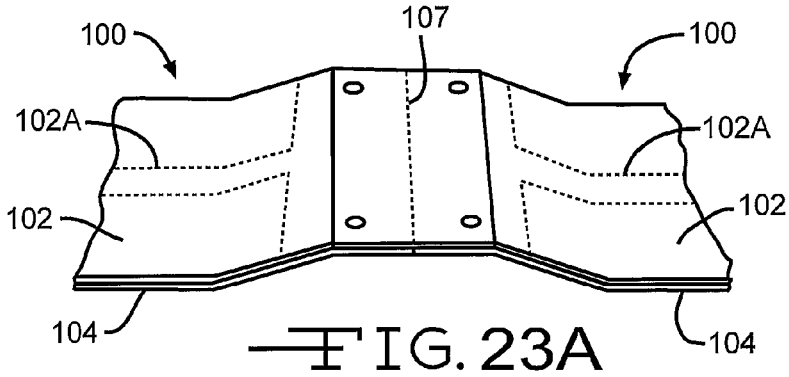
FIG. 23A is perspective view of a portion of a fourth embodiment of the wall of the container shown in FIG. 16.
Figure 23B:
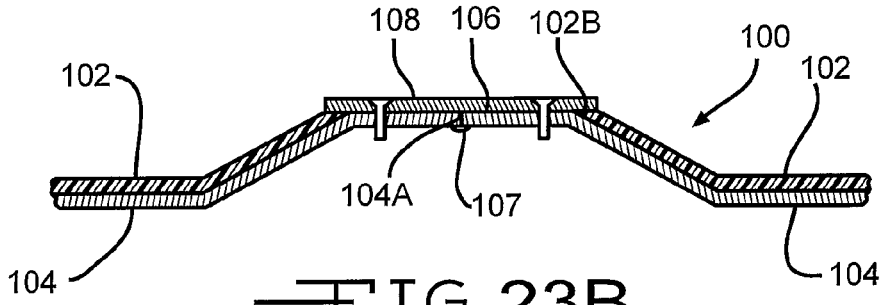
FIG. 23B is an end view in section of the wall shown in FIG. 23A.

A fourth embodiment of the shipping container panel 100 is illustrated in FIGS. 23A and 23B. FIG. 23A illustrates portions of two corrugated panels 100 having a composite body 102 and a steel support and edge element 104. The composite body 102 further includes a first electrical circuit 102A embedded in the body 102. The composite body 102 also defines a longitudinally extending edge 102B.

As best shown in FIG. 23B, the illustrated support and edge element 104 has a surface shape corresponding to the shape of the composite body 102. In the illustrated embodiment, the composite body 102 is corrugated. The support and edge element 104 defines a longitudinally extending edge 104A which extends outward from the longitudinally extending edge 102B. The edges 104A of adjacent panels 100 are joined together at a welded seam 107. An elongated plate 108 is mounted to an outwardly facing surface 106 of the joined panels 100 adjacent the welded seam 107. The plate 108 extends between the edges 102B of the adjacent composite bodies 102. The plate 108 may be formed from any desired material such as aluminum, steel, or other metals, non-metals, and composites.

Any desired connector, such as the connectors 40, 50, and 60 described in detail above, may be mounted to the surface 106 to connect the first electrical circuits 102A of the adjacent panels 100. Alternatively, any other desired electrical connector may be used to connect the first electrical circuits 102A of the adjacent panels 100. The plate 108 may be attached to the panels 100 by any desired means, such as with mechanical fasteners 109. The fasteners 109 may be any desired fastener such as threaded fasteners or rivets.

Figure 24:
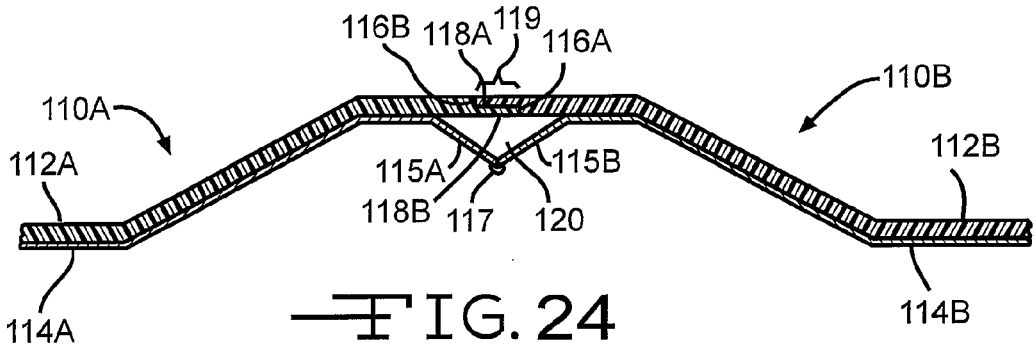
FIG. 24 is an end view in section of a fifth embodiment of the wall of the container shown in FIG. 16.

A fifth embodiment of the shipping container panel is illustrated in FIG. 24. FIG. 24 shows a panel-to-panel connection and illustrates portions of two corrugated panels 110A and 110B having a composite bodies 112A and 112B, respectively, and steel support and edge elements 114A and 114B, respectively. The composite bodies 112A and 112B further include a first electrical circuit (not shown) embedded in the composite bodies 112A and 112B. The composite body 112A defines a longitudinally extending edge 116A having an outwardly extending first tab 118A. The composite body 112B also defines a longitudinally extending edge 116B having an outwardly extending first tab 118B. The first and second tabs 118A and 118B overlap to define an interlocking seam 119. In one embodiment, the first electrical circuit in the body 112A is connected to the first electrical circuit in the body 112B within the overlapping portions of the first and second tabs 118A and 118B.

The illustrated support and edge elements 114A and 114B have a surface shape corresponding to the shape of the composite bodies 112A and 112B, respectively. In the illustrated embodiment, the composite bodies 112A and 112B are corrugated. The support and edge element 114A defines a longitudinally extending edge portion 115A which is bent inwardly away from the joined composite bodies 112A and 112B. The support and edge element 114B defines a longitudinally extending edge portion 115B which is also bent inwardly away from the joined composite bodies 112A and 112B. The edge portions 115A and 115B of adjacent panels 110A and 110B are joined together at a welded seam 117. The space between the composite bodies 112A and 112B and the support and edge elements 114A and 114B adjacent the seam 117 defines an elongated cavity 120.

If desired, a connector, such as the connectors 40, 50, and 60 described in detail above, may be mounted within the cavity 120 to connect the first electrical circuit in the body 112A to the first electrical circuit in the body 112B.

Figure 25:
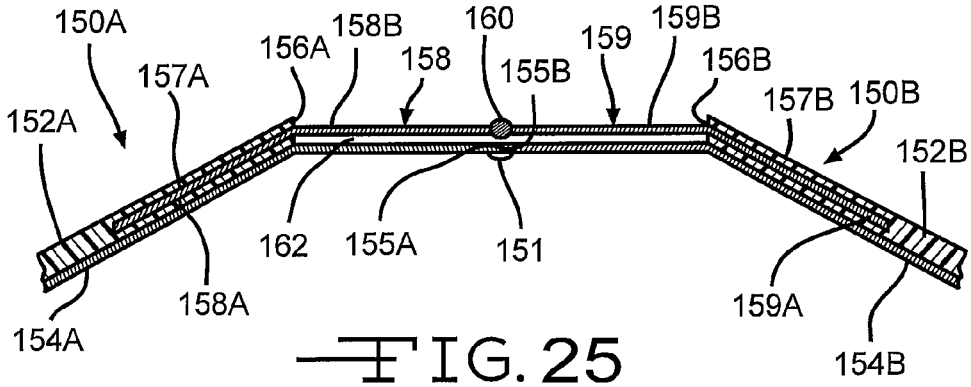
FIG. 25 is an end view in section of a sixth embodiment of the wall of the container shown in FIG. 16, further showing a fourth embodiment of the connector shown in FIG. 16.

A sixth embodiment of the shipping container panel 150 is illustrated in FIG. 25. FIG. 25 shows a panel-to-panel connection and illustrates portions of two corrugated panels 150A and 150B having a composite bodies 152A and 152B, respectively, and steel support and edge elements 154A and 154B, respectively. The composite bodies 152A and 152B further include a first electrical circuit (not shown) embedded in the composite bodies 152A and 152B. The composite body 152A defines a longitudinally extending edge 156A having a longitudinally extending slot 157A. The composite body 152B also defines a longitudinally extending edge 156B having a longitudinally extending slot 157B.

The illustrated support and edge elements 154A and 154B have a surface shape corresponding to the shape of the composite bodies 152A and 152B, respectively. In the illustrated embodiment, the composite bodies 152A and 152B are corrugated. The support and edge elements 154A and 154B define longitudinally extending edges 155A and 155B which are joined together at a welded seam 151.

A first elongated metallic tab 158 has a first portion 158A and a second portion 158B. Similarly, a second elongated metallic tab 159 has a first portion 159A and a second portion 159B. The portions 158A and 159A are mounted within the slots 157A and 157B, respectively, of the adjacent composite bodies 152A and 152B. The second portions 158B and 159B are joined together at a welded seam 160. An elongated cavity 160 is defined between the support and edge elements 154A and 154B and the second portions 158B and 159B, respectively.

The tabs 158 and 158 may define an electrical connection between the first electrical circuit (not shown) in the body 152A and the first electrical circuit (not shown) in the body 152B. Alternatively, any desired connector, such as the connectors 40, 50, and 60 described in detail above, may be mounted within the cavity 160 to connect the first electrical circuits of the adjacent panels 150A and 150B. Additionally, any other desired electrical connector may be used to connect the first electrical circuits of the adjacent panels 150A and 150B. If desired, the protective material 80 may be applied to an outwardly facing surface of the tabs 158 and 159.

Referring now to FIGS. 26A through 26D, alternate embodiments of first electrical circuits are illustrated generally at 200, 210, 220, and 230, respectively. The first electrical circuits may be embedded in the composite body of composite panels, such as the composite panels 32 illustrated in FIGS. 16 and 17.

Figures 26A, 26B, 26C, 26D:
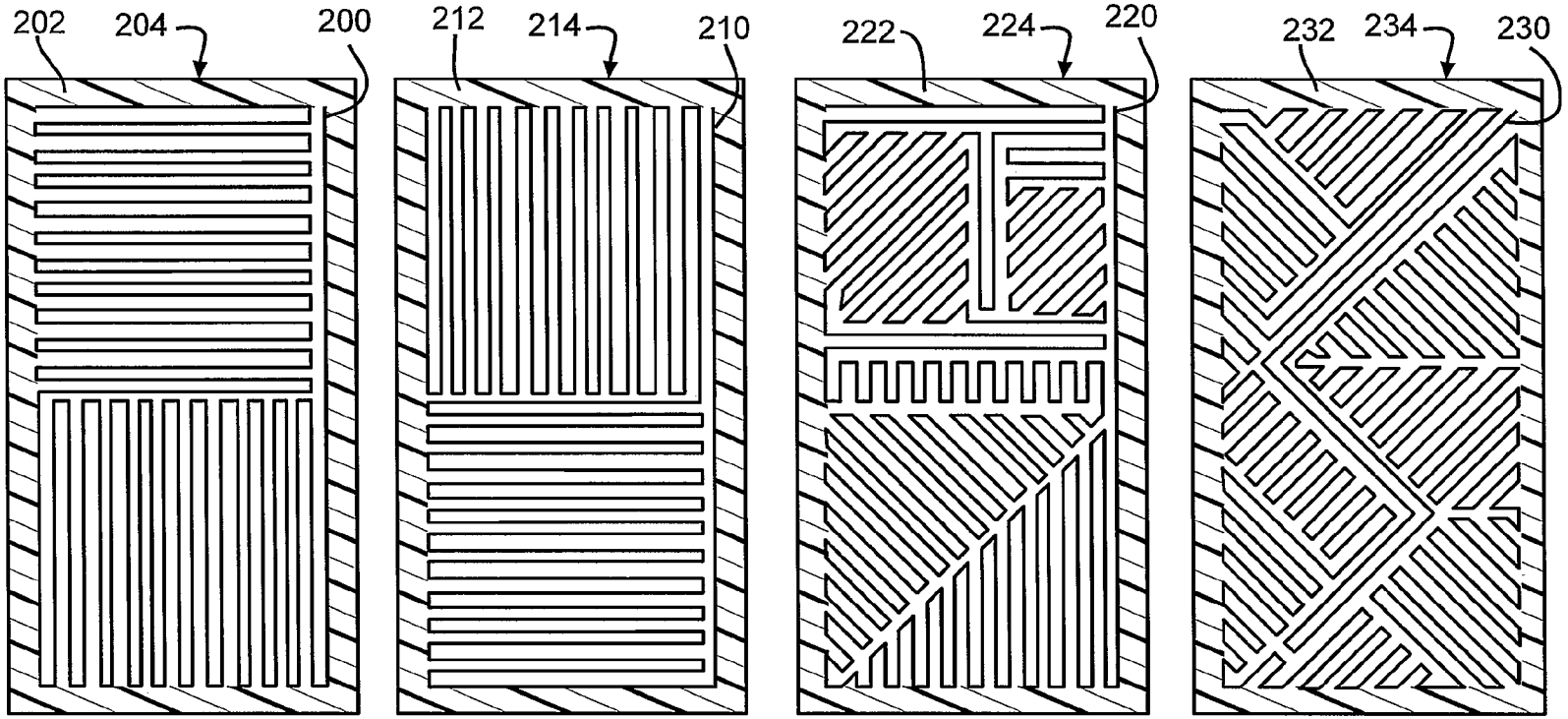
FIG. 26A is a plan view in section of a first embodiment of an electrical grid pattern for a panel illustrated in FIG. 16.
FIG. 26B is a plan view in section of a second embodiment of an electrical grid pattern for a panel illustrated in FIG. 16.
FIG. 26C is a plan view in section of a third embodiment of an electrical grid pattern for a panel illustrated in FIG. 16.
FIG. 26D is a plan view in section of a fourth embodiment of an electrical grid pattern for a panel illustrated in FIG. 16.

For example, in FIG. 26A the first electrical circuit 200 is embedded in a composite panel body 202 of a composite panel 204. Similarly, the first electrical circuits 210, 220, 230 are embedded in composite panel bodies 212, 222, and 232, of composite panels 214, 224, and 234, respectively.

The first electrical circuits define an electrically conductive path that may be formed in any desired pattern. In any shipping container 10, a plurality of composite panels having varied patterns of first electrical circuits may be used. The first electrical circuits 200, 210, 220, and 230 in the panels 204, 214, 224, and 234 represent four varied serpentine and/or geometric patterns that may be used. It will be understood the first electrical circuits 200, 210, 220, and 230 may also have any desired number of bypass resistors (not shown), so that when a conductive path is broken, at least a portion of the electrical current is diverted through one or more of the bypass resistors. Alternatively, the first electrical circuits may have any other desired serpentine and/or geometric patterns.

Additionally, the varied geometric patterns of first electrical circuits and resistors as shown in FIGS. 26A through 26D define unique panel circuit geometry and unique resistance and/or capacitance properties with in each panel. Thus, the varied geometric patterns of first electrical circuits and resistors as shown in FIGS. 26A through 26D provide an indication of the specific location within the panel of an attempted breach, such as a hole, crack, cut, or other intrusion.

Figure 27:
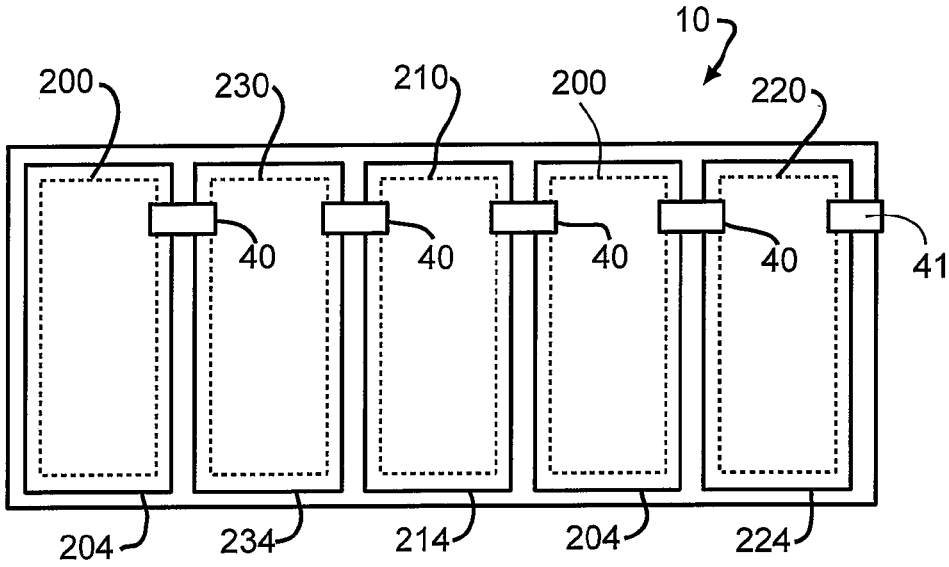
FIG. 27 is a schematic elevational view of a shipping container having a varied arrangement of panels.

The varied patterns of electrical circuits 200, 210, 220, and 230 in the panels 204, 214, 224, and 234 may be arranged on a shipping container 10 in a varied or random manner, such as schematically illustrated in FIG. 27. In the embodiment illustrated in FIG. 27, the first electrical circuits 200, 210, 220, and 230 in the panels 204, 214, 224, and 234, respectively, are connected by any desired connector, such as the connector 40.

Figure 28:
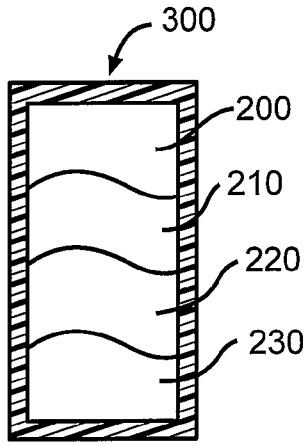
FIG. 28 is a schematic plan view of a panel having four layers of electrical circuits.
Figure 29:
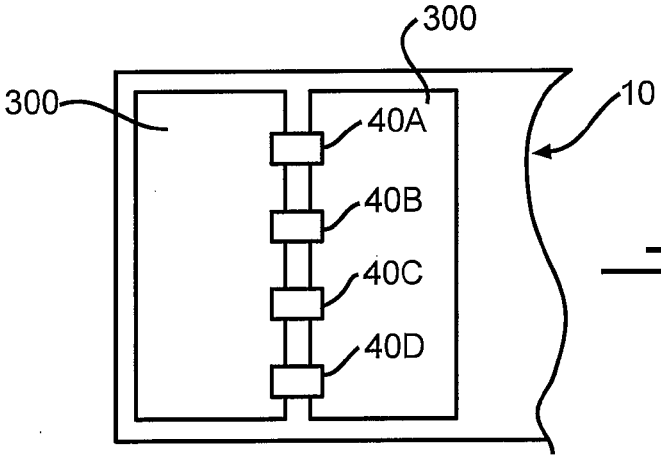
FIG. 29 is a schematic elevational view of a portion of a shipping container having a plurality of the panels illustrated in FIG. 28.

FIG. 28 is a schematic illustration of a composite panel 300 having four layers of electrical circuits 200, 210, 220, and 230. FIG. 29 is a schematic illustration of a portion of a shipping container 10 having a plurality of the panels 300. Adjacent panels 300 are connected by four connectors. In the illustrated embodiment, each connector connects a different layer of electrical circuit. For example, the connectors 40A through 40D each connect different layers of electrical circuits in the adjacent panels 300. Such an arrangement of electrical circuits and panels increases redundancy and security. It will be understood that similar panels may be formed having desired number of layers of electrical circuits, such as two or more layers of electrical circuits.

The principle and mode of operation of the breach detection system for a container have been described in its preferred embodiment. However, it should be noted that the breach detection system for a container described herein may be practiced otherwise than as specifically illustrated and described without departing from its scope.

What is claimed is:

1. A breach detection system for a container comprising:

at least two panels having a first electrical circuit mounted thereto and configured for attachment to a container;

wherein the first electrical circuit is configured to detect an intrusion through any portion of the panel and generate an intrusion signal when the intrusion occurs; and a connector having a connector body with adjacent laminated panels and a second electrical circuit at least partially embedded in the adjacent laminated panels of the connector body electrically connecting the first electrical circuits of two panels of the container, wherein the adjacent laminated panels are composed of a composite material comprising a resin, wherein the second electrical circuit is formed from a foil, wire mesh, or screen composed of a porous or perforated, electrical conductor comprising an electrically conductive metal or alloy thereof and wherein the resin of the composite material of the adjacent laminated panels is infused into pores or perforations of the porous or perforated, electrical conductor.

2. The breach detection system according to claim 1, wherein the second electrical circuit is substantially embedded within the adjacent laminated panels of the connector body.

3. The breach detection system according to claim 2, wherein the second electrical circuit comprises a pattern of electrical conductors.

4. The breach detection system according to claim 1, wherein the first electrical circuit includes a pattern of electrical conductors.

5. The breach detection system according to claim 1, wherein the first electrical circuit is embedded within each panel of the container.

6. The breach detection system according to claim 5, wherein the first electrical circuit comprises a pattern of electrical conductors.

7. The breach detection system according to claim 1, further including a monitor for monitoring one of the capacitance of the first electrical circuit and the resistance of the first electrical circuit;

wherein the monitor is configured to detect an intrusion through any portion of the panel when a predetermined change in one of the capacitance and the resistance of the first electrical circuit occurs.

8. The breach detection system according to claim 7, wherein the first electrical circuit in each panel has a unique geometric pattern.

9. The breach detection system according to claim 1, wherein the panels in the breach detection system include a plurality of patterns of electrical conductors arranged in layers; and wherein the arrangement of any one panel relative to another panel in the breach detection system is varied.

10. The breach detection system according to claim 9, wherein each layer of the patterns of electrical conductors defines a discrete electrical circuit connected to at least one of another layer of the patterns of electrical conductors and an electrical circuit in at least one adjacent panel.

11. A container having the breach detection system according to claim 1 and further comprising a frame; wherein the at least two panels define one of a container wall and two adjacent container walls.

12. The container according to claim 11, wherein the second electrical circuit comprises a pattern of electrical conductors.

13. The container according to claim 11, wherein the first electrical circuit is embedded within each panel of the container; and wherein the first electrical circuit comprises a pattern of electrical conductors.

14. The container according to claim 11, further including a monitor for monitoring one of the capacitance of the first electrical circuit and the resistance of the first electrical circuit;

wherein the monitor is configured to detect an intrusion through any portion of the panel when a predetermined change in one of the capacitance and the resistance of the first electrical circuit occurs.

15. The breach detection system according to claim 14, wherein the first electrical circuit in each panel has a unique geometric pattern.

16. The container according to claim 1, wherein the panels in the breach detection system include a plurality of patterns of electrical conductors arranged in layers; and wherein the arrangement of any one panel relative to another panel in the breach detection system is varied.

17. The container according to claim 16, wherein each layer of the patterns of electrical conductors defines a discrete electrical circuit connected to at least one of another layer of the patterns of electrical conductors and an electrical circuit in at least one adjacent panel.

18. A connector for connecting component panels of a breach detection system for a container comprising:

a connector body; and a pattern of electrical conductors embedded in the connector body and defining an electrical circuit, the electrical circuit being formed from a foil, wire mesh, or screen consisting essentially of a porous or perforated, electrically conductive metal or alloy thereof;

wherein the connector electrically connects electrical circuits of two panels of a breach detection system of a container; and wherein the electrical circuits are configured to detect an intrusion through any portion of the panel and generate an intrusion signal when the intrusion occurs.

19. A breach detection system for a container comprising:

at least two panels configured for attachment to a container;

a first electrical circuit embedded in each panel, the first electrical circuit configured to detect an intrusion through any portion of the panel and generate an intrusion signal when the intrusion occurs, the first electrical circuit having a ribbon-like configuration, being formed from a foil, wire mesh, or screen composed of a porous or perforated, electrically conductive metal or alloy thereof in the absence of any other conductive or semiconductive material, and arranged in a pattern such that adjacent longitudinal edges of the ribbon-like first electrical circuit are spaced apart, and that panel material extends through the pores or perforations of the porous or perforated, electrically conductive metal or alloy thereof; and a connector electrically connecting the first electrical circuits of two panels of the container.

20. The breach detection system according to claim 19, wherein the first electrical circuit is arranged in a serpentine pattern.

21. The breach detection system according to claim 1, wherein the second electrical circuit is formed from a foil composed of a porous, electrical conductor comprising an electrically conductive metal or alloy thereof.

22. The breach detection system according to claim 1, wherein the second electrical circuit is formed from a wire mesh composed of a porous, electrical conductor comprising an electrically conductive metal or alloy thereof.

23. The breach detection system according to claim 1, wherein the second electrical circuit is formed from a screen composed of a porous, electrical conductor comprising an electrically conductive metal or alloy thereof.

24. The breach detection system according to claim 1, wherein the second electrical circuit is formed from a foil composed of a perforated, electrical conductor comprising an electrically conductive metal or alloy thereof.

25. The breach detection system according to claim 1, wherein the second electrical circuit is formed from a wire mesh composed of a perforated, electrical conductor comprising an electrically conductive metal or alloy thereof.

26. The breach detection system according to claim 1, wherein the second electrical circuit is formed from a screen composed of a perforated, electrical conductor comprising an electrically conductive metal or alloy thereof.

27. The breach detection system according to claim 18, wherein the electrical circuit is formed from a foil consisting essentially of a porous, electrically conductive metal or alloy thereof.

28. The breach detection system according to claim 18, wherein the electrical circuit is formed from a wire mesh consisting essentially of a porous, electrically conductive metal or alloy thereof.

29. The breach detection system according to claim 18, wherein the electrical circuit is formed from a screen consisting essentially of a porous, electrically conductive metal or alloy thereof.

30. The breach detection system according to claim 18, wherein the electrical circuit is formed from a foil consisting essentially of a perforated, electrically conductive metal or alloy thereof.

31. The breach detection system according to claim 18, wherein the electrical circuit is formed from a wire mesh consisting essentially of a perforated, electrically conductive metal or alloy thereof.

32. The breach detection system according to claim 18, wherein the electrical circuit is formed from a screen consisting essentially of a perforated, electrically conductive metal or alloy thereof.

* * * * *